US007225824B2

(12) United States Patent
West et al.

(10) Patent No.: US 7,225,824 B2
(45) Date of Patent: Jun. 5, 2007

(54) DIP TUBE ANCHOR ASSEMBLY AND RELATED CONTAINER

(75) Inventors: Derik R. West, Logan, UT (US); Jeremy L. Branscomb, Logan, UT (US); Todd S. Theurer, Providence, UT (US); Michael E. Goodwin, Logan, UT (US)

(73) Assignee: Hyclone Laboratories, Inc., Logan, UT (US)

( * ) Notice: Subject to any disclaimer, the term of this patent is extended or adjusted under 35 U.S.C. 154(b) by 395 days.

(21) Appl. No.: 10/954,090

(22) Filed: Sep. 29, 2004

(65) Prior Publication Data

US 2006/0065310 A1 Mar. 30, 2006

(51) Int. Cl.
*B65D 88/54* (2006.01)
*B65D 83/32* (2006.01)

(52) U.S. Cl. ..... 137/15.01; 137/152; 137/590

(58) Field of Classification Search ..... 137/152, 137/590, 15.01
See application file for complete search history.

(56) References Cited

U.S. PATENT DOCUMENTS

| | | | | |
|---|---|---|---|---|
| 1,894,655 | A * | 1/1933 | Auchincloss | 137/590 |
| 2,174,354 | A * | 9/1939 | Shields | 137/590 |
| 3,082,024 | A * | 3/1963 | Boylan | 137/590 |
| 4,114,783 | A * | 9/1978 | Wempe et al. | 137/590 |
| 4,184,511 | A * | 1/1980 | Wilson | 137/590 |
| 4,237,928 | A * | 12/1980 | Messersmith | 137/590 |
| 5,799,830 | A | 9/1998 | Carroll et al. | |
| 5,941,635 | A | 8/1999 | Stewart | |
| 6,071,005 | A | 6/2000 | Ekambaram et al. | |
| 6,083,587 | A | 7/2000 | Smith et al. | |
| 6,086,574 | A | 7/2000 | Carroll et al. | |
| 6,328,064 | B1 * | 12/2001 | Garfield | 137/590 |
| 6,427,873 | B2 * | 8/2002 | Wilcox | 222/95 |
| 6,523,561 | B2 * | 2/2003 | Kapcoe et al. | 137/590 |
| 2002/0131654 | A1 | 9/2002 | Smith et al. | |
| 2003/0077466 | A1 | 4/2003 | Smith et al. | |
| 2004/0261889 | A1 | 12/2004 | Elgan et al. | |

* cited by examiner

*Primary Examiner*—John Rivell
(74) *Attorney, Agent, or Firm*—Workman Nydegger

(57) ABSTRACT

A container assembly includes a container bounding a chamber and having a floor. A well is mounted on the floor of the container. The well bounds a compartment that extends below the floor of the container and communicates with the chamber of the container. An anchor has a side wall with a first port opening formed at a first end and a second port opening formed on the side wall or at a second end of the anchor. A fluid passageway extends between the first port opening and the second port opening. At least a portion of the anchor is secured within the compartment of the well such that at least a portion of the second port opening is disposed within the compartment. A dip tube is fluid coupled with the first port opening of the anchor.

58 Claims, 18 Drawing Sheets

DIP TUBE ANCHOR ASSEMBLY AND RELATED CONTAINER

CROSS-REFERENCE TO RELATED APPLICATIONS

Not applicable.

BACKGROUND OF THE INVENTION

1. The Field of the Invention

The present invention relates to dip tube anchors and related containers in which a dip tube is disposed.

2. The Relevant Technology

Dip tubes are commonly used in association with various types of containers for withdrawing a fluid from the containers. A dip tube simply comprises a tube having a first end that is lowed into a container so as to be disposed toward the bottom of the container. A second end of the tube extends out through the top of the container. By applying one of various different types of forces, the fluid can be selectively removed from the container by entering through the first end of the dip tube and exiting through the second end of the dip tube. The first end of the dip tube is typically located near the bottom of the container so as to maximize removal of all of the fluid from the container, thereby minimizing waste of the fluid.

Although dip tubes as discussed above are commonly use, they have a number of shortcomings. For example, dip tubes are commonly formed from flexible polymeric tubing that is typically coiled upon formation. Dip tubes made from such tubing have a natural tendency to partially coil or bend when disposed within the container. As a result, the first end of the dip tube is spaced upward, away from of the bottom of container. The dip tube is thus unable to remove all of the fluid from the container without further manipulation of the container and/or the dip tube. Where the fluid is highly expensive, such as is commonly found in the biotechnology industry, this shortcoming can be a significant detriment.

In one attempt to overcome the above problem, an anchor is used to secure the dip tube to the bottom of the container. The anchor comprises a flat plate from which a tubular spout projects. A first opening is formed on the side of the spout next to the pate. A second opening is formed on the upper free end of the spout. A passageway extends between the two openings. The plate is secured on the interior surface of the floor of the container so that the stem projects up into the container. The first end of the dip tube is coupled with the upper end of the spout. As such, fluid enters through the first opening on the spout and travels up through the spout and into the dip tube.

Although use of such anchors solves some problems, it creates others. For example, many of the containers used to hold the fluid comprise a collapsible polymeric bag. An adhesive is used to secure the plate of the anchor to the floor of the bag. The use of an adhesive inside of the bag, however, is problematic in that it increases the risk that unwanted contaminates could leech from the adhesive into the fluid. Furthermore, acceptable adhesives are often found to have insufficient strength, thereby resulting in the anchor breaking free from the bag during manufacture, transport or use.

In addition, securing the plate of the anchor to interior surface of the floor of the bag is a difficult manufacturing step to automate. Thus, the process typically requires that the anchor be manually secured to the bag, thereby slowing production and increasing cost. Finally, because the spout of the anchor projects above the plate which is mounted on the floor of the bag, the first opening on the spout is still not the low point on the floor of the container. As such, the dip tube is still unable to capture a portion of the fluid within the container.

Accordingly, what is needed in the art are improved ways for enabling a dip tube to maximize the removal of fluid from a container.

BRIEF DESCRIPTION OF THE DRAWINGS

Various embodiments of the present invention will now be discussed with reference to the appended drawings. It is appreciated that these drawings depict only typical embodiments of the invention and are therefore not to be considered limiting of its scope.

DETAILED DESCRIPTION OF THE PREFERRED EMBODIMENTS

Figure 1:
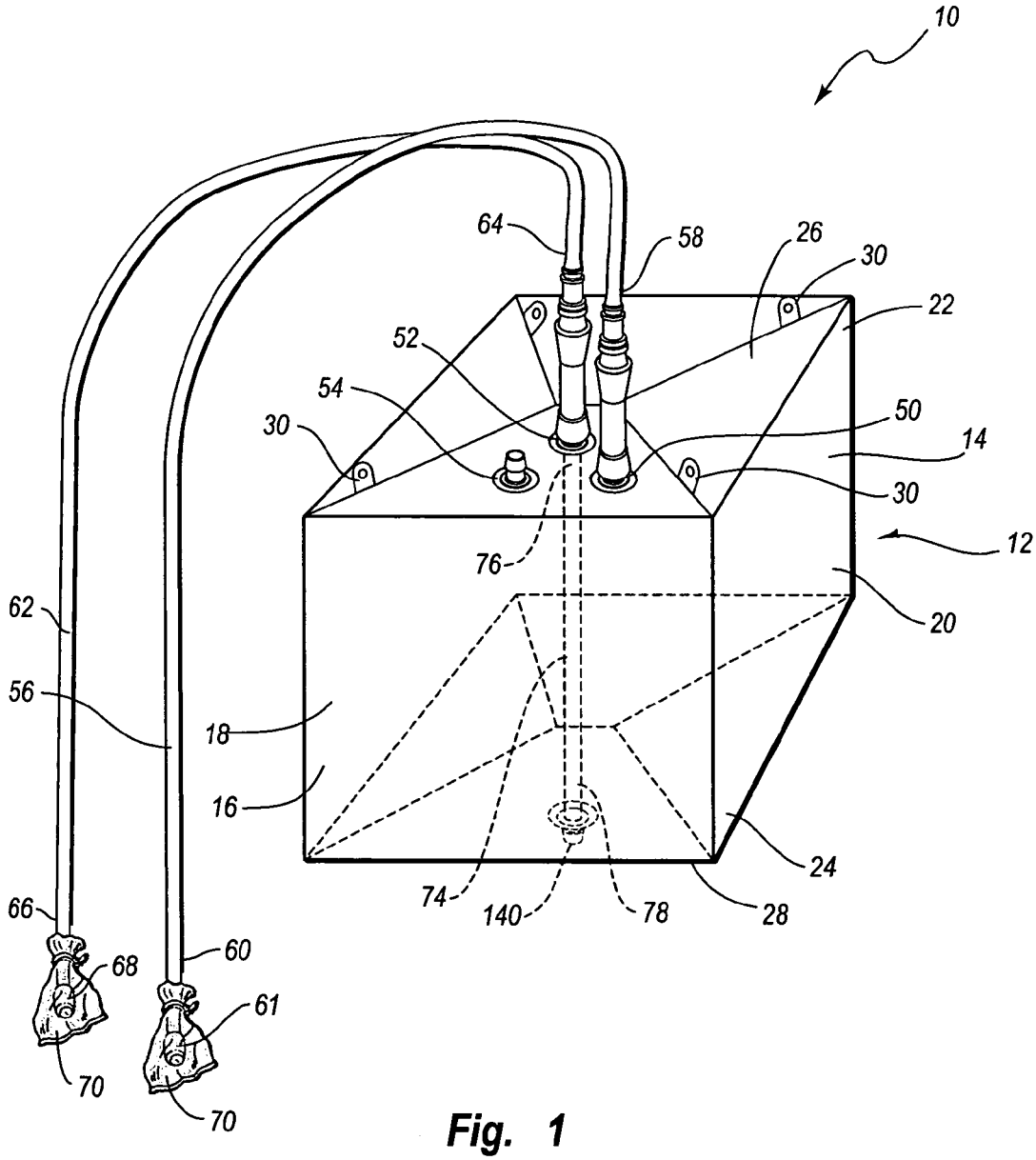
FIG. 1 is a perspective view of one embodiment of a container assembly.

Depicted in FIG. 1 is one embodiment of a container assembly 10 incorporating features of the present invention. Container assembly 10 comprises a container 12 configured to hold a fluid that may or may not include solid particles. By way of example and not by limitation, the fluid can comprise culture media, serum, buffers, reagents, vaccines, cell cultures, water, process liquids, or any other type of fluids. Such fluids can be intended to be sterile or non-sterile or they can be filtered or non-filtered. Container 12 can also be used for mixing, culturing, processing, storing, transporting, dispensing, or other conventional handling or uses of fluids.

Container 12 comprises a flexible body 14 having an interior surface 16 that bounds a chamber 18. In one embodiment, body 14 comprises a collapsible bag. In alternative embodiments, body 14 can comprise more rigid structures. Chamber 18 can be any desired volume. For example, chamber 18 can be configured to hold a volume of at least 10 liters, 50 liters, 100 liters, 500 liters, 1,000 liters or any other desired volume.

Body 14 is typically comprised of a flexible, water impermeable material such as a low-density polyethylene or other polymeric sheets having a thickness in a range between about 0.1 mm to about 5 mm with about 0.2 mm to about 2 mm being more common. Other thicknesses can also be used. The material can be comprised of a single ply material or can comprise two or more layers which are either sealed together or separated to form a double wall container. Where the layers are sealed together, the material can comprise a laminated or extruded material. The laminated material comprises two or more separately formed layers that are subsequently secured together by an adhesive.

The extruded material comprises a single integral sheet which comprises two or more layer of different material that are each separated by a contact layer. All of the layers are simultaneously co-extruded. One example of an extruded material that can be used in the present invention is the HyQ CX3-9 film available from HyClone Laboratories, Inc. out of Logan, Utah. The HyQ CX3-9 film is a three-layer, 9 mil cast film produced in a cGMP facility. The outer layer is a polyester elastomer coextruded with an ultra-low density polyethylene product contact layer. Another example of an extruded material that can be used in the present invention is the HyQ CX5-14 cast film also available from HyClone Laboratories, Inc. The HyQ CX5-14 cast film comprises a polyester elastomer outer layer, an ultra-low density polyethylene contact layer, and an EVOH barrier layer disposed therebetween.

Still another example of a film that can be used is the Attane film which is likewise available from HyClone Laboratories, Inc. The Attane film is produced from three independent webs of blown film. The two inner webs are each a 4 mil monolayer polyethylene film (which is referred to by HyClone as the HyQ BM1 film) while the outer barrier web is a 5.5 mil thick 6-layer coextrusion film (which is referred to by HyClone as the HyQ BX6 film). In yet other embodiments, body 130 can be made exclusively of the HyQ BM1 film or the HyQ BX6 film.

The HyQ CX5-14 cast film and the Attane type films, as discussed above, include a gas barrier layer that prevents the migration of contaminating gases into chamber 18. Forming body 14 with a gas barrier layer is useful when it is desired to maintain sterility in the fluid housed within container 12 and to keep the fluid free of any gas phase.

In one embodiment, the material for body 14 is approved for direct contact with living cells and is capable of maintaining a solution sterile. In such an embodiment, the material can also be sterilizable such as by ionizing radiation. Other examples of materials that can be used are disclosed in U.S. Pat. No. 6,083,587 which issued on Jul. 4, 2000 and U.S. patent application Ser. No. 10/044,636, filed Oct. 19, 2001, which are hereby incorporated by specific reference.

In the embodiment depicted, body 14 comprises a three-dimensional bag. More specifically, body 14 comprises an encircling side wall 20 that, when body 14 is unfolded, has a substantially polygonal transverse cross section that extends between a first end 22 and an opposing second end 24. In alternative embodiments, side wall 20 can have a circular, elliptical, irregular or any other transverse cross section. First end 22 terminates at a two dimensional top end wall 26 while bottom end 24 terminates at a two dimensional bottom end wall 28. Although not required, in one embodiment a plurality of spaced apart loops 30 are formed on top end wall 26. Loops 30 enable container 12 to be lifted and supported, if desired, during filling of fluid into container 12.

Figure 2:
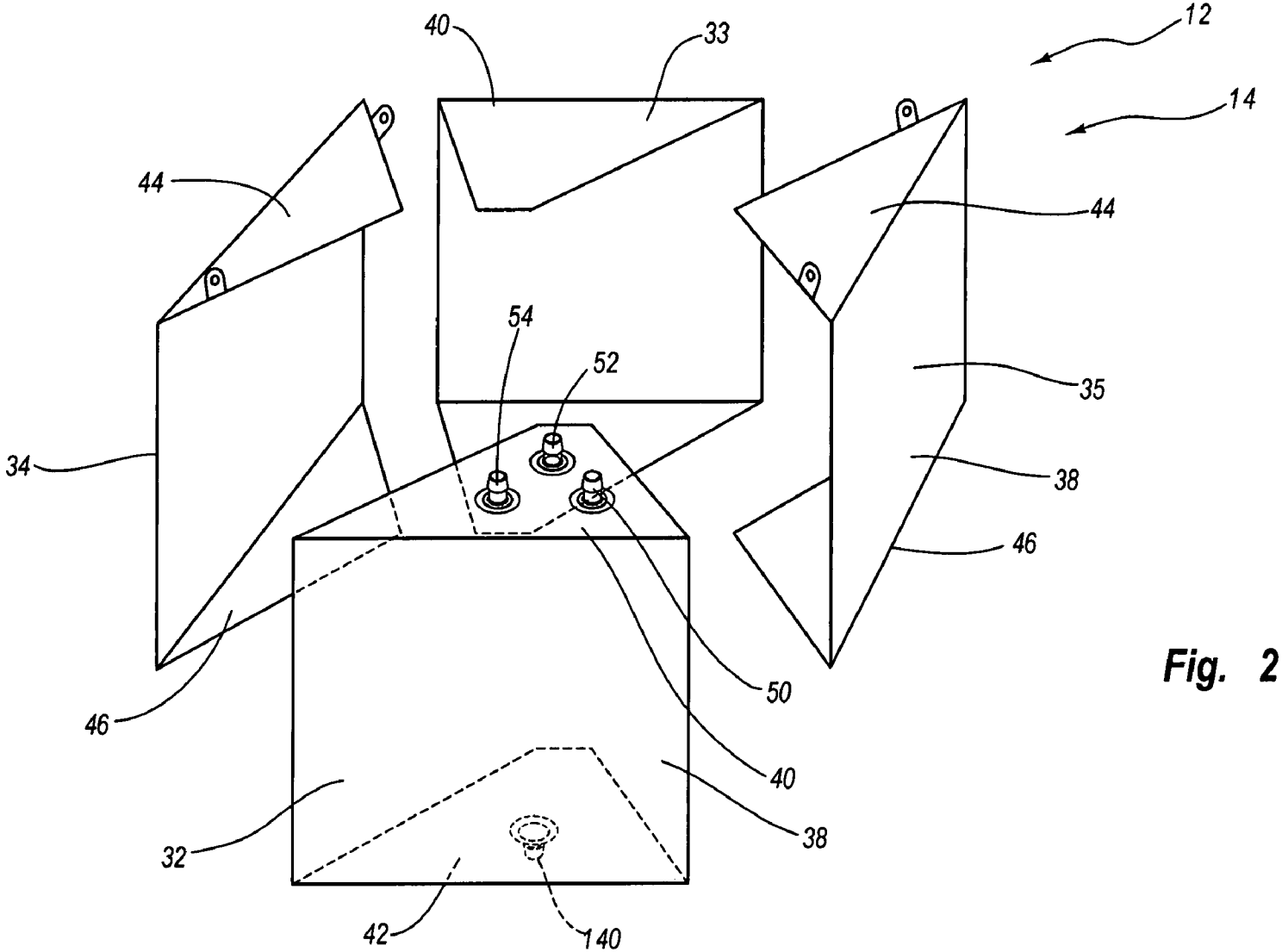
FIG. 2 is an exploded view of the container of the container assembly shown in FIG. 1.

Turning to FIG. 2, three dimensional body 14 is comprised of four discrete panels, i.e., a front panel 32, a back panel 33, a first side panel 34, and a second side panel 35. Each panel 32-35 has a substantially square or rectangular central portion 38. Front panel 32 and back panel 33 each have a first end portion 40 and a second end portion 42 projecting from opposing ends of central portion 38. Each of end portions 40 and 42 have a trapezoidal configuration with opposing tapered sides. Each of side panels 34 and 35 has a triangular first end portion 44 and an opposing triangular second end portion 46 at the opposing ends of central portion 38. As depicted in FIG. 1, corresponding perimeter edges of each panel 32-35 are seamed together so as to form body 14 having a substantially box shaped or parallelepiped configuration.

In the assembled configuration, each of panels 32-35 is folded along the intersection of the central portion and each of the end portions such that end portions combine to form top end wall 26 and bottom end wall 28. In alternative embodiments, the end portions can be used to form the sides.

Panels 32-35 are seamed together using methods known in the art such as heat energies, RF energies, sonics, other sealing energies, adhesives, or other conventional processes. It is appreciated that by altering the size and configuration of some or all of panels 32-35, body 14 can be formed having a variety of different sizes and configurations. The size and configuration of body 14 can also be altered by varying the number of panels used to make body 14.

In still other embodiments, it is appreciated that body 14 can be formed by initially extruding or otherwise forming a polymeric sheet in the form of a continuous tube. Each end of the tube can then be folded like the end of paper bag and then seamed closed so as to form a three dimensional body. In still another embodiment, a length of tube can be laid flat so as to form two opposing folded edges. The two folded edges are then inverted inward so as to form a pleat on each side. The opposing ends of the tube are then seamed closed. Finally, an angled seam is formed across each corner so as to form a three dimensional bag when unfolded.

In the embodiment depicted, body 14 comprises a three dimensional bag as discussed above. In an alternative embodiment, however, body 14 can comprises a two-dimensional pillow style bag wherein two sheets of material are placed in overlapping relation and the two sheets are bounded together at their peripheries to form chamber 18. Alternatively, a single sheet of material can be folded over and seamed around the periphery to form chamber 18. In yet another embodiment, body 14 can be formed from a continuous tubular extrusion of polymeric material that is cut to length and opposing ends seamed closed. In still other embodiments, it is appreciated that body 14 can comprises an open ended bag. For example, top end wall 26 of body 14 can be eliminated. The open ended configuration for body 14 can be formed as either a three-dimensional bag or a two-dimensional pillow style bag.

It is appreciated that body 14 can be manufactured to have virtually any desired size, shape, and configuration. It is appreciated that the above techniques can be mixed and matched with one or more polymeric sheets and that there are still a variety of other ways in which body 14 can be formed having a two or three dimensional configuration. Further disclosure with regard to one method of manufacturing three-dimensional bags is disclosed in U.S. patent application Ser. No. 09/813,351, filed on Mar. 19, 2001 of which the drawings and Detailed Description are hereby incorporated by specific reference.

Container 12 further comprises a plurality of tubular ports mounted on body 14 so as to communicate with chamber 18. As depicted in FIG. 2, a fill port 50, a drain port 52, and one or more secondary ports 54 are mounted on first end portion 40 of front panel 32 of body 14. As will be discussed below in greater detail, fill port 50 is used for delivering fluid to chamber 18 while drain port 52 us used to withdraw fluid from chamber 18. The number and uses of secondary ports 54 depend in part on the type, processing, and intended use of the fluid being stored with chamber 18. For example, the one or more secondary ports 54 can be used to provide circulation of the fluid within chamber 18 or can be used for adding components or taking samples. When not in use, the one or more secondary ports 54 can be sealed closed such as by a cap. Alternatively, secondary ports 54 can be eliminated. It is likewise appreciated that the ports can come in a variety of different sizes, shapes and configurations.

Container assembly 10 also comprises a tubular delivery line 56 and a tubular drain line 62. Delivery line 56 has a proximal end 58 fluid coupled with fill port 50 and an opposing distal end 60 that terminates at a distal tip 61. Drain line 62 has a proximal end 64 fluid coupled with drain port 52 and an opposing distal end 66 that terminates at a distal tip 68. In the embodiments depicted, distal tips 61 and 68 are each removably sealed within a corresponding sterile bag 70. Once container assembly 10 is completely assembled, the assembly can be sterilized such as by radiation. Bags 70 seal access to chamber 18 through lines 56 and 62 so as to ensure that chamber 18 remains sterile prior to use. Where the fluid being processed need not be sterile, the sterilization process and the use of bags 70 can be eliminated.

Figure 3:
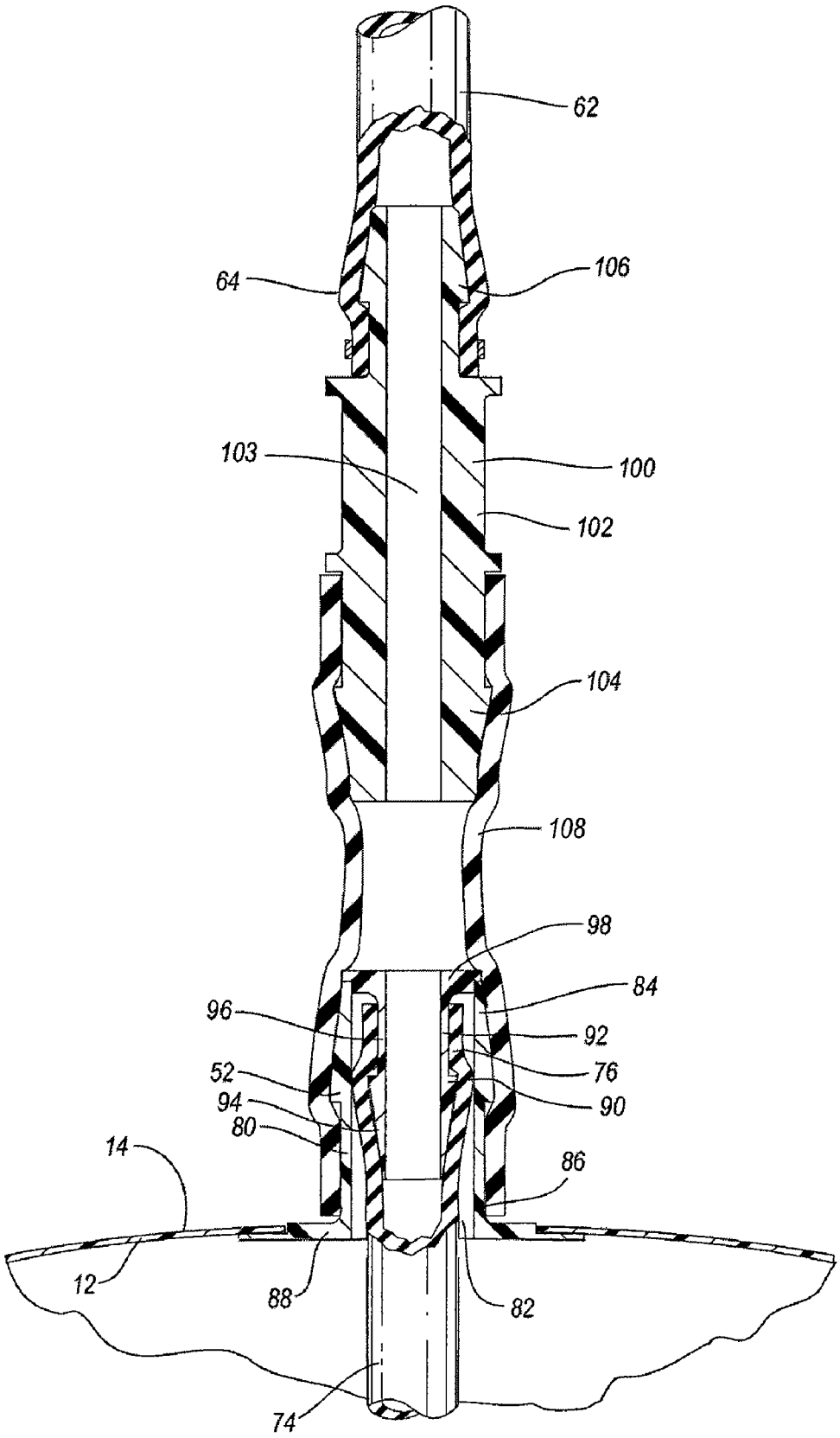
FIG. 3 is a cross sectional side view of a dip tube connector of the container assembly shown in FIG. 1.

As depicted in FIG. 1, container assembly 10 also includes a dip tube 74 at least partially disposed within chamber 18 of container 12. Dip tube 74 has a first end 76 disposed at drain port 52 and an opposing second end 78 disposed toward bottom end wall 28 of container 12. Depicted in FIG. 3 is one embodiment of how dip tube 74 can be mounted to container 12. Specifically, drain port 52 comprises a tubular, barbed stem 80 that bounds a channel 82 extending therethrough. Stem 80 has a first end 84 and an opposing second end 86. A flange 88 is mounted on second end 86 of stem 80 and is secured to front panel 32 of container 12.

A diptube connector 90 is partially disposed within drain port 52. Diptube connector 90 comprises a tubular, barbed stem 92 having a first end 94 and an opposing second end 96. An annular flange 98 encircles and outwardly projects from second end 96 of stem 92. Flange 98 has a maximum diameter that is larger than or equal to the first end 84 of drain port 52. During assembly, first end 94 of diptube connector 90 is secured by frictional engagement within first end 76 of dip tube 74. Second end 78 of dip tube 74 is advanced through drain port 52 until flange 98 of diptube connector 90 seats on first end 84 of drain port 52.

To enable diptube connector 90 to fit within drain port 52, drain port 52 is typically made of an increased size. In one embodiment, an adapter 100 is used to reduce the size of the tube that extends from drain port 52. Adapter 100 comprises a tubular body 102 that bounds a channel 103 extending between a barbed first end 104 and an opposing barbed second end 106. First end 104 of adapter 100 has a configuration and size similar to first end 84 of drain port 52. A transition tube 108 is fluid coupled with and extends from first end 84 of drain port 52 to first end 104 of adapter 100. In contrast, second end 106 of adapter 100 is smaller than first end 104 and thus is sized to fit within proximal end 62 of drain tube 62 that is smaller than transition tube 108.

In one embodiment, ports 50 and 52 can be the same size and lines 56 and 62 can be the same size. In this embodiment, the same assembly as discussed above that is used to fluid couple drain line 62 to drain port 52 can be used to fluid couple delivery line 56 to fill port 50. In an alternative embodiment, fill port 50 can be smaller than drain port 52. In this embodiment, delivery line 56 can fluid couple directly to fill port 50. It is also appreciated that drain line 62 can be sized to fluid couple directly to drain port 52. Further disclosure with regard to diptube connector 90 and adapter 100 is provided in U.S. Pat. No. 6,086,574, issued Jul. 11, 2000, which is incorporated herein by specific reference.

Figure 4:
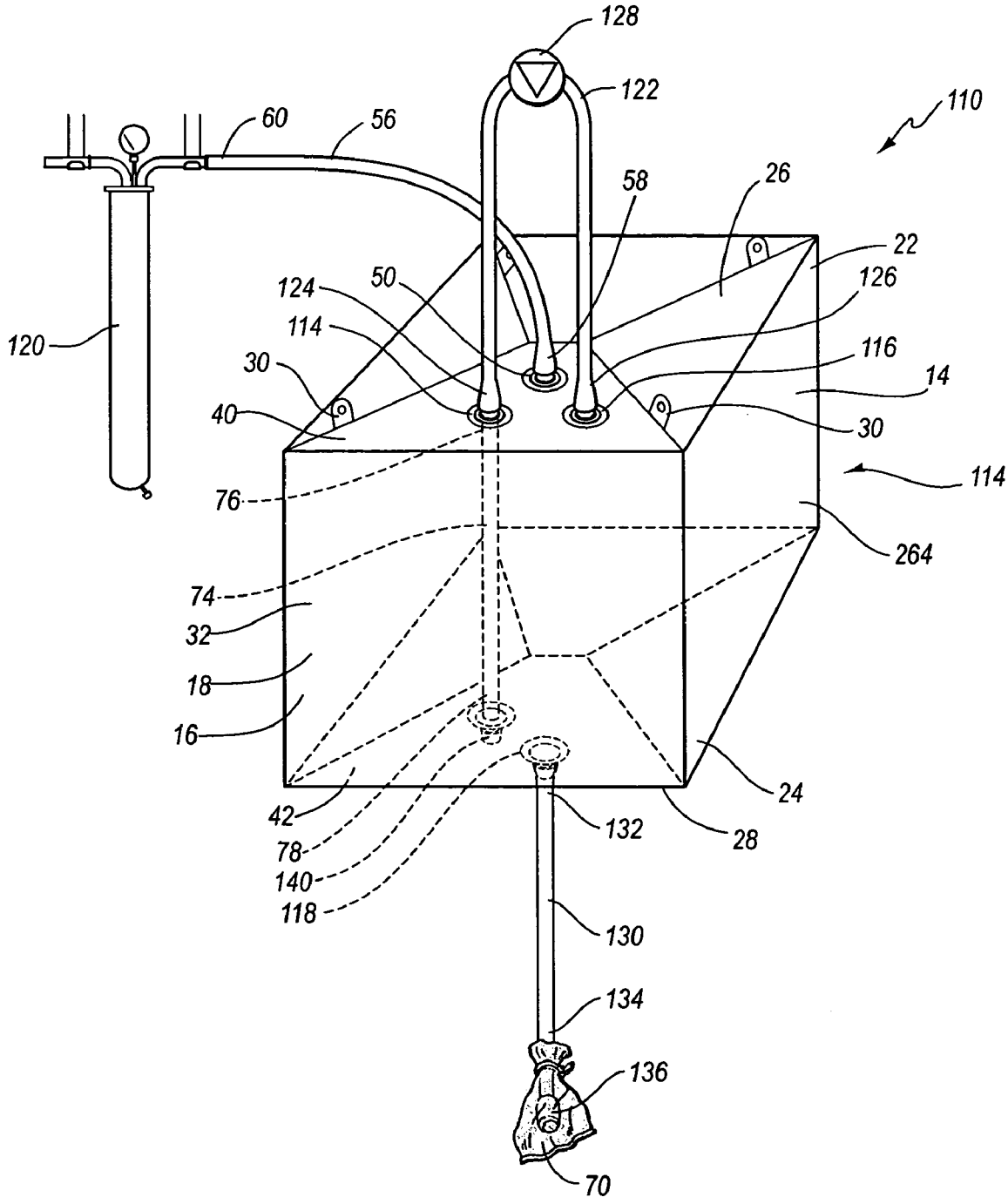
FIG. 4 is a perspective view of an alternative embodiment of a container assembly.

In the embodiment depicted in FIG. 1, drain tube 74 is used for dispensing the fluid from container 12. It is also appreciated, however, that drain tube 74 can be used for different purposes. For example, depicted in FIG. 4 is an alternative embodiment of a container assembly 110 wherein like elements between container assemblies 10 and 110 are identified by like reference characters.

Specifically, container assembly 110 comprises a container 112. Container 112 includes body 14 having fill port 50 and two circulation ports 114 and 116 mounted on first end portion 40 of front panel 32. A drain port 118 is mounted on bottom portion 42 of front panel 32. Proximal end 58 of delivery line 56 is fluid coupled with fill port 50 while distal end 60 of delivery line 56 is coupled with a filter 120. Filter 120 can be coupled with delivery line 56 at the initial manufacturing stage. The entire container assembly 110, including filter 120, line 60 and container 112, can then be simultaneously sterilized. Filter 120 thus prevents any unwanted contaminates from entering chamber 18.

Container assembly 110 further comprises a circulation line 122 having a first end 124 fluid coupled with port 114 and a second end 126 fluid coupled with port 116. A pump 128 is coupled with circulation line 122. Pump 128 functions to draw fluid a located at the bottom of container 112 up through dip tube 74, through circulation line 122 and then back into the top of container 112 though port 116. The operation of pump 128 thus functions to mix or circulate the fluid within container so that the fluid becomes and/or remains homogenous. Although any type of pump can be used, in one embodiment pump 128 comprises a peristaltic pump. Because the peristaltic pump does not directly contact the fluid, the peristaltic pump can be repeatedly used for different batches or fluids without cleaning or risk of contamination.

Container assembly 110 further includes a drain line 130 having a proximal end 132 fluid coupled with drain port 118 and an opposing distal end 134 that terminates at a distal tip 136. Distal tip 136 is also sealed within a bag 70.

It is appreciated that the various features of container assembles 10 and 110 can be mixed and matched and that still other alternative features and designs can be incorporated therein. For example, it is appreciated that delivery line 56 can also be coupled with a dip tube 74 extending into container 12. The use of this second dip tube can be used to help minimizing aeration or foaming of the fluid as the fluid is delivered to container 12. In like manner, second end 126 of circulation line 122 can also have a dip tube 74 extending therefrom. In each case, a separate dip tube anchor assembly 140, discussed below, can be mounted on the lower end of each dip tube.

In still other embodiments, it is appreciated that delivery line 56 can be eliminated from container assembly 10. In this embodiment, drain line 62 can be used to both deliver fluid into container 12 and remove fluid from container 12. It is further appreciated that the various dip tubes and anchor assembly 140 can also be used for delivering one or more gases to container 12 such as in sparging. For example, air or oxygen can be passed down through the dip tube and out anchor assembly 140 so that the air or oxygen can oxygenate the fluid within container 12.

Figure 5:
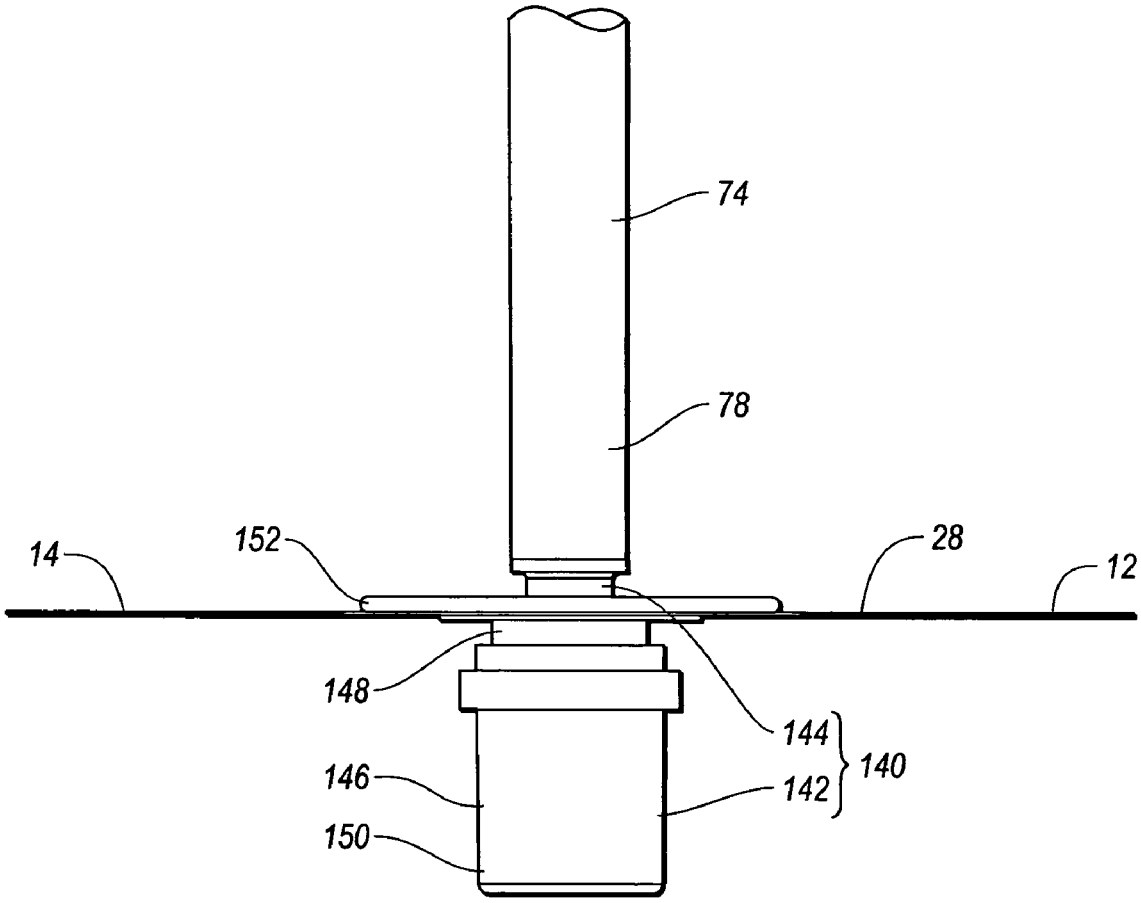
FIG. 5 is an elevated side view of a dip tube anchor assembly of the container assembly show in FIG. 1.

In both container assemblies 10 and 110, second end 78 of dip tube 74 is coupled with a dip tube anchor assembly 140. As depicted in FIG. 5, dip tube anchor assembly 140 generally comprises a well 142 mounted to container 12 and an anchor 144 connected to well 142. Well 142 generally comprises a reservoir 146 having a first end 148 and an opposing second end 150. A mounting flange 152 outwardly projects from first end 148 of reservoir 146.

It is appreciated that well 142 can come in a variety different sizes and shapes and can be comprised of a variety of different components. For example, in the embodiment depicted in FIG. 6, well 142 is comprised of a port 154 and a cap 156. Port 154 comprises a tubular stem 158 having an exterior surface 160 extending between a first end 162 and an opposing second end 164. Encircling and outwardly projecting from exterior surface 160 at second end 164 is an annular barb 166. Stem 158 also has an interior surface 168 that bounds a passage 170 (FIG. 7) extending through port 154.

Mounting flange 152 encircles and radially outwardly projects from exterior surface 160 at first end 162 of stem 158. Mounting flange 152 has a front face 172 and an opposing back face 174. It is appreciated that mounting flange 152 can have a variety of different sizes and configurations. Furthermore, as opposed to radially, outwardly projecting in a single plane, it is also appreciated that flange 152 can be sloped so as to form a frustoconical configuration.

Figure 6:
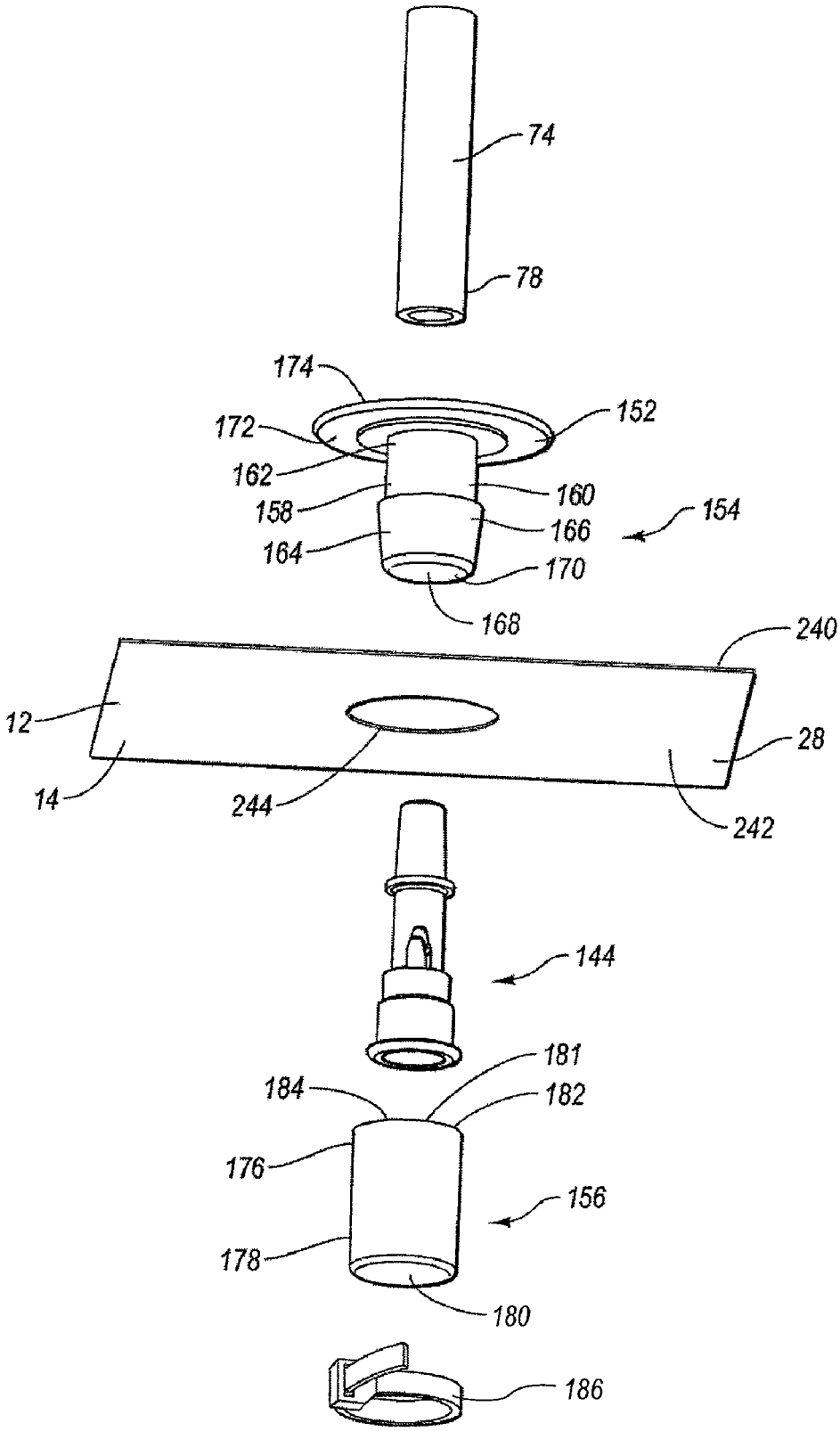
FIG. 6 is an exploded perspective view of the dip tube anchor assembly shown in FIG. 5.
Figure 7:
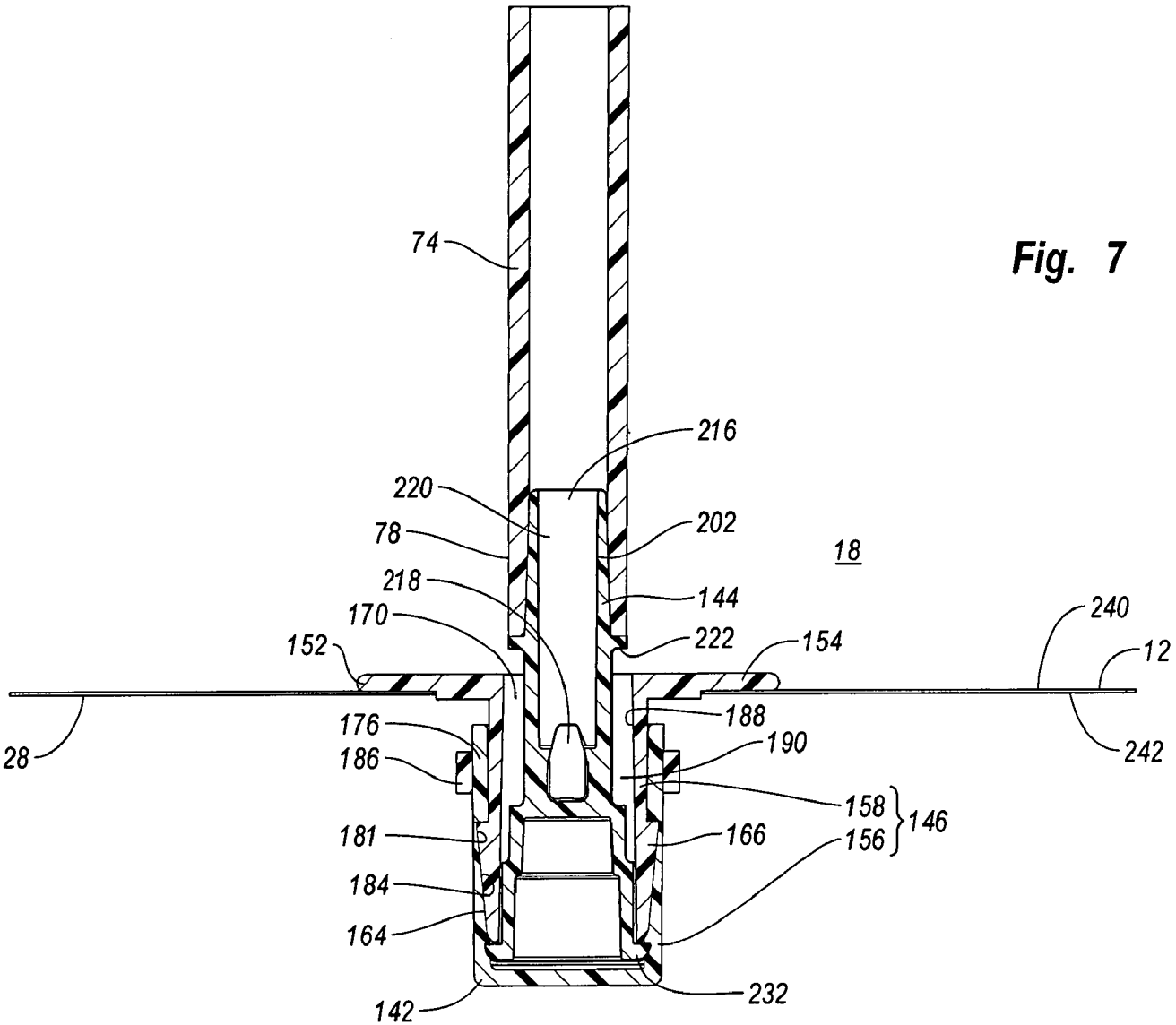
FIG. 7 is a cross sectional side view of the dip tube anchor assembly shown in FIG. 5.

As also illustrated in FIG. 6, bottom end wall 28 of container 12 has an interior surface 240 and an opposing exterior surface 242. During assembly, an opening 244 is formed through bottom end wall 28. Stem 158 of port 154 is passed through opening 244 such that front face 172 of mounting flange 152 rests against interior surface 240 of container 12. In this configuration, as depicted in FIG. 7, mounting flange 152 is sealed to bottom end wall 28 such as by welding, adhesive, or the like. In an alternative embodiment, it is also envisioned that back face 174 of mounting flange 152 can be sealed against exterior surface of bottom end wall 28 such that port 154 is aligned with opening 244. In either event, however, stem 158 projects below bottom end wall 28.

Here it is noted that because stem 158 projects outside of container 12, as opposed to into container 12, conventional automated manufacturing techniques can be used weld mounting flange 152 to container 12. This increases manufacturing and eliminates the need for using adhesives. Alternatively, however, adhesives can still be used to secure mounting flange 152 to container 12.

Returning to FIG. 6, cap 156 has a first end 176 and an opposing second end 178. An end wall 180 is formed at second end 178 so as to seal second end 178 closed. Cap 156 also has an interior surface 181 that bounds a cavity 184 (FIG. 7). An opening 182 is formed at first end 176 and provides access to cavity 184. Cap 156 is typically made from a flexible polymeric material, although other materials can also be used.

As depicted in FIG. 7, cap 156 is sized so that stem 158 can be selectively received within cavity 184. In this configuration, barb 166 engages with the interior surface 181 of cap 156 so as to form a secure fluid-type connection therewith. To further secure the engagement and fluid-type connection between cap 156 and port 154, a tie 186 can be secured around first end 176 of cap 156 so as to securely bias cap 156 against stem 158 and thereby further bias barb 166 against cap 156. Tie 186 can be replaced by a crimp, press fit compression ring, clamp, or any other structure that can bias cap 156 against stem 158. Furthermore, barb 166 can be eliminated or replaced with an annular rib, lip or other structure that facilitates attachment between cap 156 and stem 158. In still other embodiments, cap 156 and stem 158 can be configured so as to mechanically interlock or to be secured together such as by welding, adhesive, or other fastening techniques.

In the embodiment depicted in FIG. 7, reservoir 146 is formed by the combination of stem 158 and cap 156. In turn, reservoir 146 has an interior surface 188 that bounds a compartment 190. Compartment 190 is in fluid communication with chamber 18 of container 12.

Figure 8:
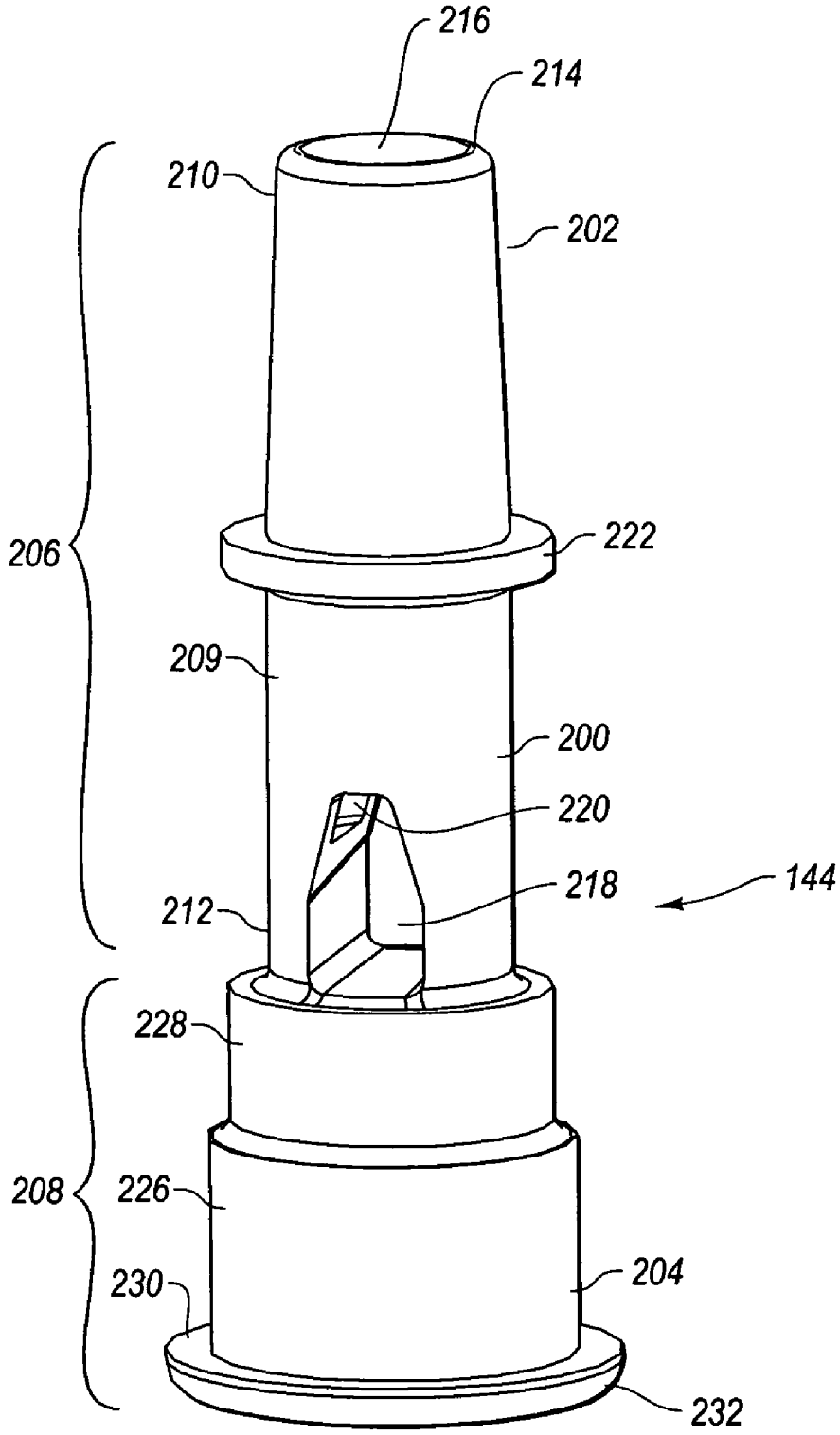
FIG. 8 is a perspective view of the anchor of the dip tube anchor assembly shown in FIG. 6.
Figure 9:
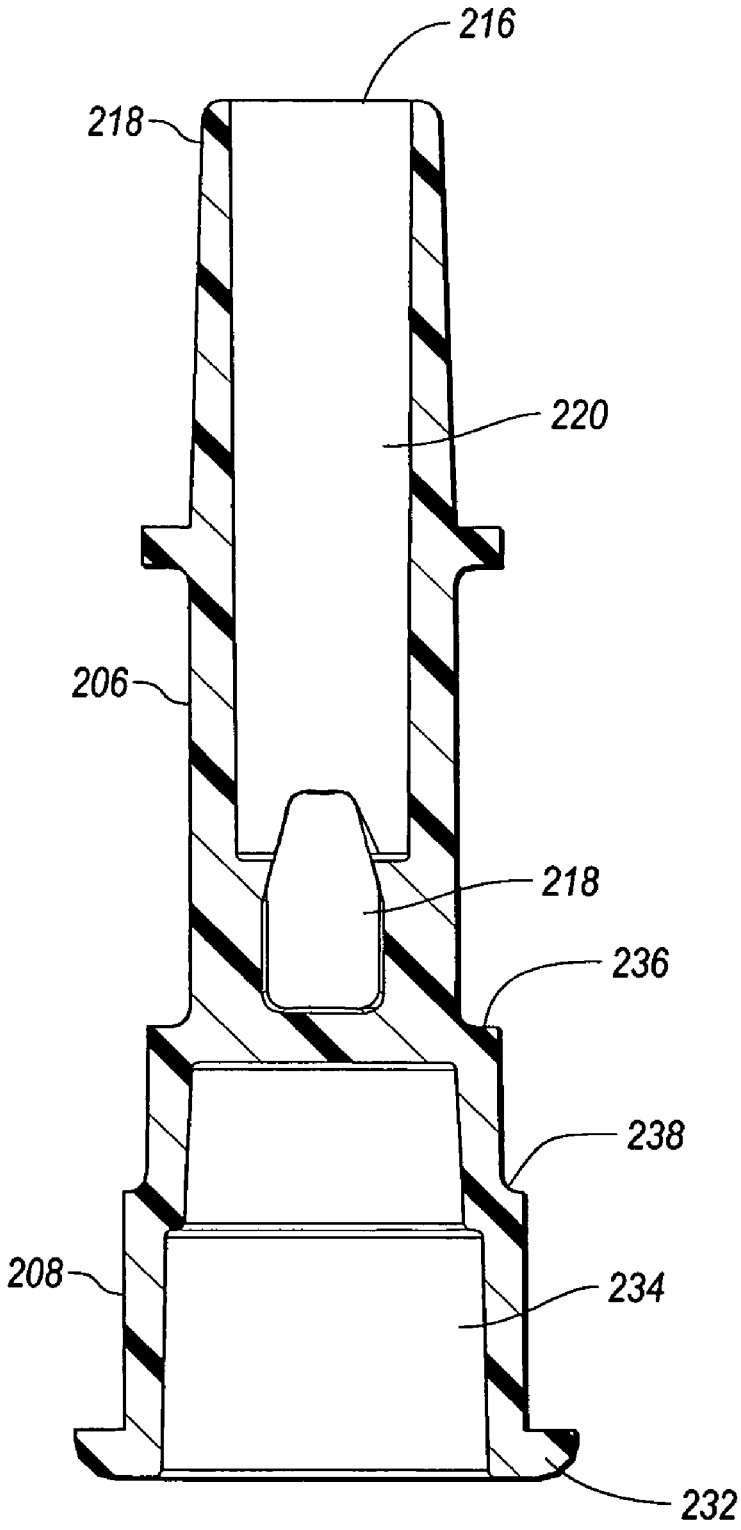
FIG. 9 is a cross sectional side view of the anchor shown in FIG. 8.

Turning to FIG. 8, anchor 144 comprises a side wall 200 extending between a first end 202 and an opposing second end 204. More specifically, however, anchor 144 comprises a tubular spout 206 mounted on a base 208. Spout 206 has a first end 210 and an opposing second end 212. First end 210 terminates at an end face 214 having a first port opening 216 formed thereat. A second port opening 218 transversely extends through tubular spout 206 at second end 212. As depicted in FIG. 9, a fluid passageway 220 extends between first port opening 216 and second port opening 218.

Returning to FIG. 8, a retainer 222 encircles and radially outwardly projects from exterior surface 209 of spout 206 at a location between first end 210 and second end 212. As will be discussed below in greater detail, retainer 222 functions as a stop for dip tube 74 so that dip tube 74 does not unintentionally cover second port opening 218. In alternative embodiments, it is appreciated that retainer 222 need not completely encircle spout 206. For example, annular retainer 222 can be replaced with a projection that partially encircles spout 206 or with a plurality of spaced apart flange, ribs, projections, or other structures that would equally function to prevent unwanted advancement of dip tube 74 over second port opening 218. Although not required, in one embodiment a portion of tubular spout 206 extending between retainer 222 and end face 214 is tapered so as to have a generally frustoconical configuration. This tapering facilitates easy insertion of first end 210 of spout 206 into dip tube 74. In one alternative, a barb can be formed on spout 206 to help maintain engagement between spout 206 and dip tube 74.

Base 208 of anchor 144 has an exterior surface 226 extending between a first end 228 and a second end 230. Spout 206 upwardly projects from first end 228 of base 208.

As depicted in FIG. 9, spout 206 has an outer diameter that is smaller than the outer diameter of base 208. As such, a shoulder 236 is formed therebetween. A second shoulder 238 centrally encircles base 208. Encircling and radially outwardly projecting from second end 230 of base 208 is a retention lip 232. A socket 234 is formed within base 208 and is accessed through second end 230.

As depicted in FIG. 7, during assembly first end 202 of anchor 144 is advanced through passage 170 of port 154 from second end 164. Anchor 144 is advanced until retention lip 232 biases against second end 164 of stem 158. That is, retention lip 232 is sized and/or configured so that retention lip 232 is stopped by second end 164 of stem 158, thereby preventing further advancement of anchor 144 into stem 158. In this regard, it is appreciated that retention lip 232 can come in a variety of different configurations and need not completely encircle base 208. Cap 156 is then secured over second end 164 of stem 158, as discussed above, thereby securing anchor 144 to well 142. The engagement between anchor 144 and well 142 can be further fixed by sizing base 208 so that base 208 biases against or is disposed adjacent to interior surface 188 of stem 158 at second end 164.

To complete the assembly, second end 78 of dip tube 74 is coupled with anchor 144 by being advanced over first end 202 of spout 206 until dip tube 74 engages against retainer 222. It is appreciated that spout 206 can project up into chamber 18 as shown in FIG. 7 or can be retained within compartment 190. In the assembled configuration, dip tube 74 is fluid coupled with fluid passageway 220 of anchor 144. Fluid can thus be drawn out of chamber 18 of container 12 by drawing fluid into passageway 220 of spout 206 though second port opening 218. The fluid then passes from spout 206 to dip tube 74 and finally out through drain line 62 (FIG. 1). Alternatively, the fluid can be circulated back into container 12 through circulation line 122 (FIG. 4).

The attachment of dip tube 74 to anchor 144 can be accomplished either before or after anchor 144 is received within stem 158. For example, second 78 of dip tube 74 can be connected to anchor 144 outside of container 12. First end 76 of diptube 74 can then be advanced up though stem 158 until anchor 144 is received within stem 158. Alternatively, second end 78 of dip tube 74 can be advanced down from drain port 52 to well 142. Second end 78 can then be connected to anchor 144 either before or after anchor 144 is received within stem 158.

In the assembled configuration shown in FIG. 7, it is noted that compartment 190 of well 142 extends below interior surface 240 of bottom end wall 28 of container 12. As such, fluid within container 12 naturally tends to drain to compartment 190 which is the low point. In one embodiment, well 142 extends below interior surface 240 of bottom end wall by a distance less than 20 cm, 15 cm, or more commonly less than 10 cm. Well 142 also has a maximum inner diameter that is typically less than 15 cm, 10 cm and more commonly less than 5 cm. Other dimensions can also be used. It is also noted that second port opening 218 of anchor 144 is at least partially disposed within compartment 190. Accordingly, because dip tube 74 draws fluid from within compartment 190, dip tube anchor assembly 140 maximize the amount of fluid that can be removed from container 12. Furthermore, as container 12 becomes empty, container 12 can be easily manipulated so that any fluid remaining within container 12 drains to compartment 190 where it is removed through dip tube 74. To further optimize the amount of fluid removed from container 12, base 208 can be designed to occupy substantially all of the space of compartment 190 below second port opening 218.

The fluid which exits through dip tube 74 must pass from chamber 18 to second port opening 218 by passing through the area between interior surface 188 of stem 158 and the exterior surface of anchor 144. As such, this area should be designed to accommodate the desired flow rate for dip tube 74. That is, the area should be large enough so that the flow rate passing through the area and reaching second port opening 218 can at least match the desired flow rate for dip tube 74. Furthermore, in some embodiments, large particles may be present in the fluid. As such, the opening between interior surface 188 of stem 158 and the exterior surface of anchor 144 should be sufficiently large to allow the particles to pass through the opening and reach second port opening 218. The size of this opening can be varied by changing the size of stem 158 and/or spout 206.

In addition to optimizing the removal of fluid from container 12, dip tube anchor assembly 140 has the additional benefit of that it can be incorporated or retrofitted into existing bag designs. That is, port 154 of anchor assembly 140 is a standard port found on the floor of different bottom drain bags. In bottom drain bags, the port is traditionally coupled with a drain line such as depicted in FIG. 4. In the present invention, however, the same port can be used to form anchor assembly 140 by simply adding cap 156 and anchor 144. Thus, a manufacturer can produce two identical bags having the same base port wherein one bag can be finished with a drain line and the other can be finished with a dip tube anchor assembly.

Figure 10:
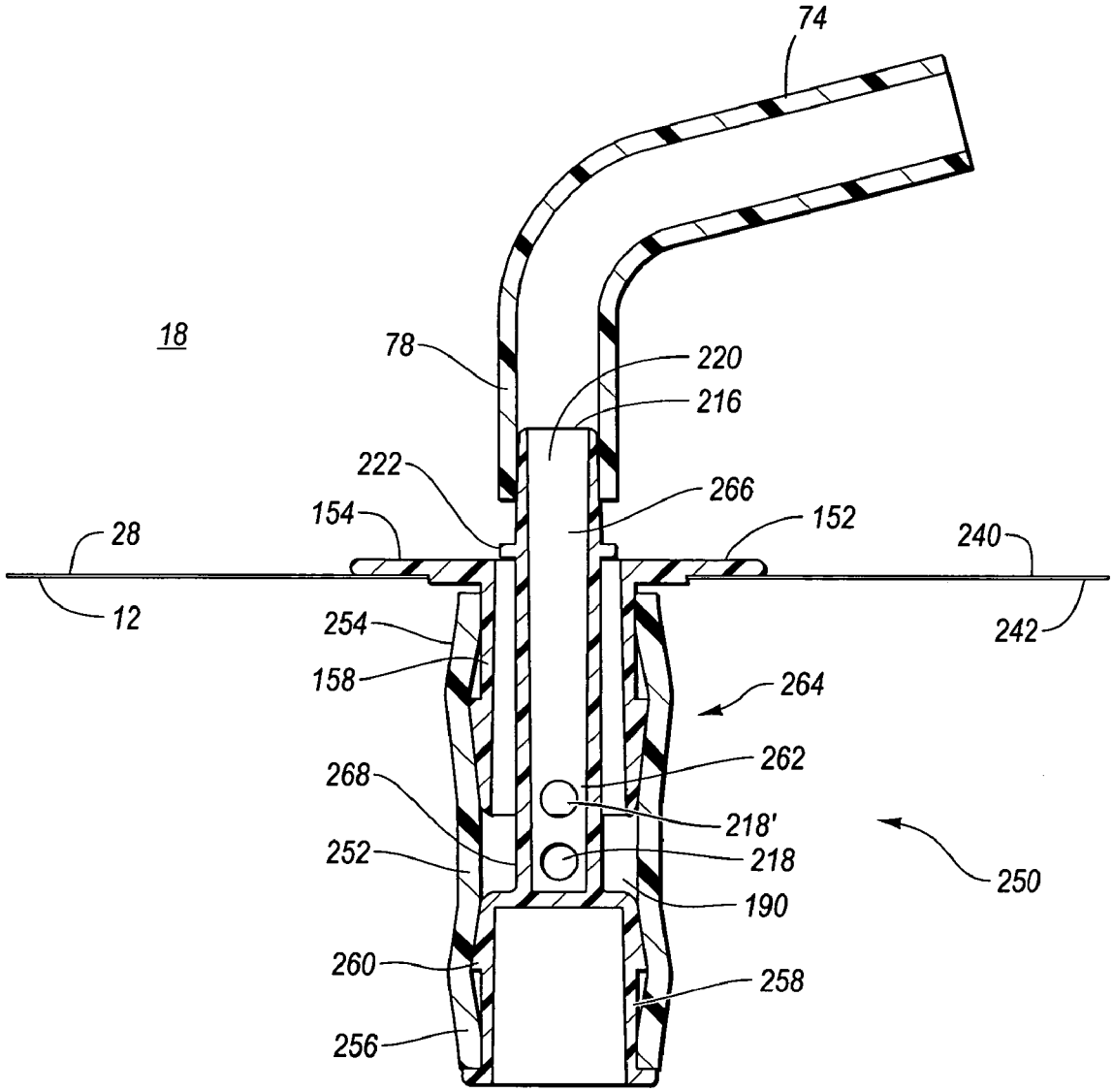
FIG. 10 is a partial cross sectional side view of an alternative embodiment of a dip tube anchor assembly that includes a tube and a plug.

It is appreciated that the dip tube anchor assembly can have a variety of other configurations. For example, depicted in FIG. 10 is a dip tube anchor assembly 250. It is appreciated that like element between the different embodiments are identified by like reference characters. Anchor assembly 250 comprises port 154 connected to bottom end wall 28 of container 12. In contrast to cap 156, however, a tube 252 is coupled with port 154. Specifically, tube 252 has a first end 254 and an opposing second end 256. First end 254 of tube 252 is advanced over stem 158 so as to form a sealed engagement therewith. A plug 258 is received within second end 256 and has an annular barb 260 formed thereon. Plug 258 forms a sealed engagement with tube 252. If desired, ties or other fasteners can be secured around ends 254 and 256 of tube 252 so as to further secure the engagement with stem 158 and plug 258. Port 154, plug 26 and tube 252 combine to form a well 264.

An anchor 262 has a first end 266 and an opposing second end 268. First port opening 216 is formed at first end 266 while second port opening 218 transversely extends through second end 268. Fluid passageway 220 extends between port openings 216 and 218. In this embodiment, anchor 262 is integrally formed with plug 258 so that anchor 262 is secured to well 264. Alternatively, anchor 262 can be connected to plug 258 or spaced part retainers can be formed projecting from anchor 262 so as to bias against stem 158, thereby preventing anchor 262 from completely passing through port 154. It is also noted in this embodiment that a supplemental second port opening 218' is formed on anchor 262. It is appreciated that the various port openings can come in any desired size, shape or number.

It is again noted that well 264 which bounds compartment 190 extends below bottom end wall 28 of container 12. Likewise, second port opening 218 is disposed within compartment 190 below bottom end wall 28 of container 12. Second end 78 of dip tube 74 is fluid coupled with first end 266 of anchor 262 such that fluid can be drawn out of chamber 18 by passing through compartment 190, second port opening 218, fluid passageway 220 and dip tube 74.

Although generally less preferred, it is also appreciated that second port opening 218 can be positioned outside of compartment 190 above bottom end wall 28. For example, this design may be used when it is desired to secure dip tube 74 but not remove the very bottom layer of fluid which may comprise unwanted sediment or other materials.

Depicted in FIG. 10 is a dip tube anchor assembly 270 incorporating features of the present invention. Anchor assembly 270 comprises a port 272 which comprises a tubular stem 274 having mounting flange 152 outwardly projecting from a first end and a first clamping flange 276 outwardly projecting from an opposing second end. Mounting flange 152 is secured to interior surface 240 of bottom end wall 28 of container 12.

Anchor assembly 270 further comprises a dish 278. Dish 278 comprises a floor 280, a side wall 282 upwardly projecting from floor 280, and a second clamping flange 284 outwardly projecting from side wall 282. Clamping flanges 276 and 284 are removably secured together by a clamp 286 with a gasket 288 disposed between flanges 276 and 284. Port 272 and dish 278 combine to form a well 290 that bounds compartment 190. In one alternative, side wall 282 can be eliminated so that dish 278 is flat.

An anchor 294 is attached to or is integrally formed with floor 280 so as to upwardly project therefrom. First port opening 216 is formed at the upper end of anchor 294 while second port opening 218 transversely extends through the bottom end of anchor 294 adjacent to floor 280. Fluid passageway 220 extends between port openings 216 and 218. Second end 78 of dip tube 74 is fluid coupled with the upper end of anchor 294. Again, compartment 190 is disposed below bottom end wall 28 and second port opening 218 is disposed within compartment 190 below bottom end wall 28.

Figure 12:
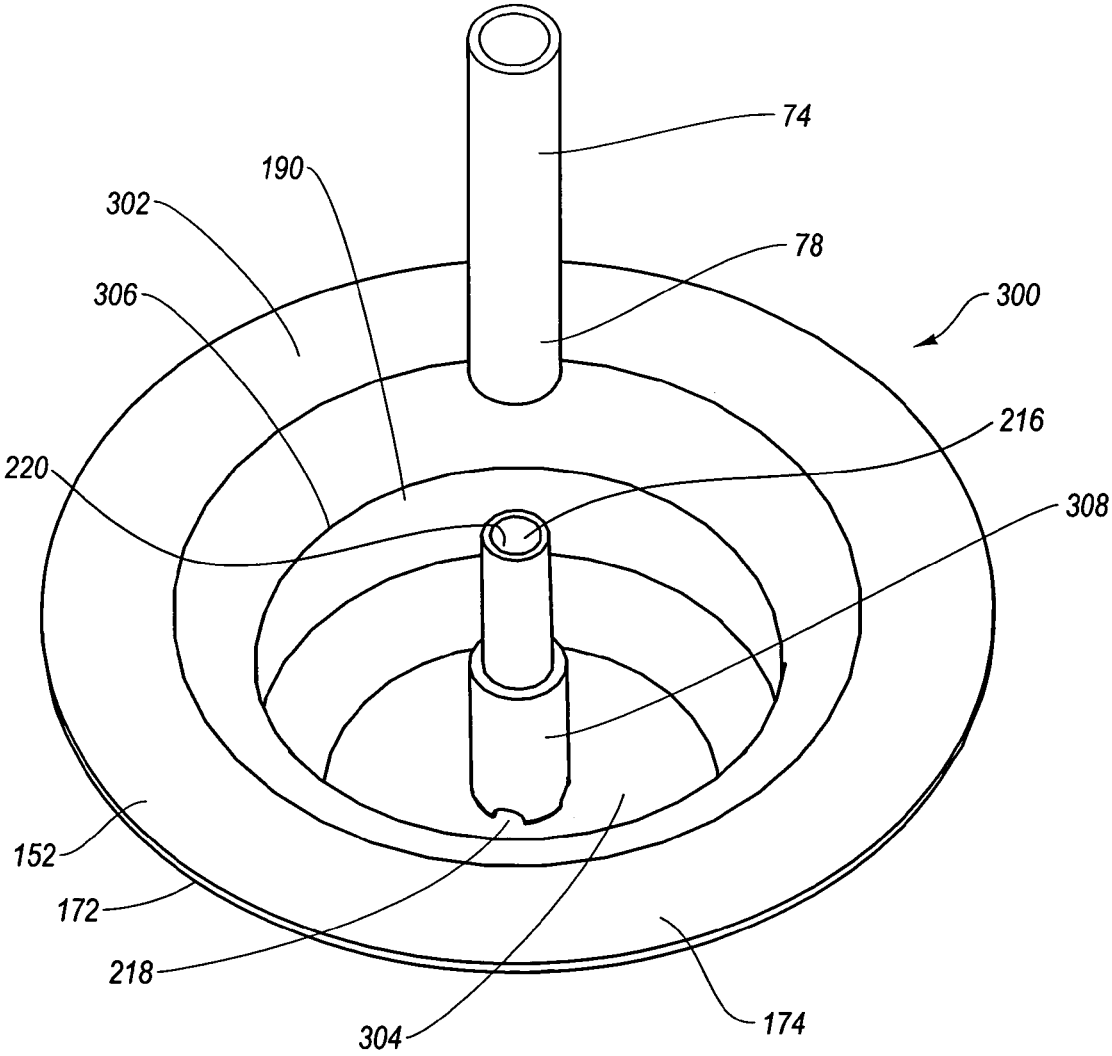
FIG. 12 is a perspective view of another alternative embodiment of a dip tube anchor assembly that includes an integral well with an anchor vertically projecting therefrom.

Depicted in FIG. 12 is still another embodiment of a dip tube anchor assembly 300 incorporating features of the present invention. This embodiment includes a well 302 formed as a single, integral dish. Specifically, well 302 comprises a floor 304, a side wall 306 upstanding from floor 304, and mounting flange 152 outwardly projecting from the top end of side wall 306. Front face 172 of mounting flange 152 is sealed against interior surface 240 of bottom end wall 28 so that side wall 306 projects down through opening 244 on bottom end wall 28 (FIG. 6).

An anchor 308 is attached to or is integrally formed with floor 304 so as to upwardly project therefrom. First port opening 216 is formed at the upper end of anchor 308 while second port opening 218 transversely extends through the bottom end of anchor 308 adjacent to floor 304. Fluid passageway 220 extends between port openings 216 and 218. The upper end of anchor 308 is configured to be secured in fluid communication with second end 78 of dip tube 74. If desired, a barb or other engaging feature can be formed at the upper end of anchor 308 to help secure this coupling. Again, compartment 190 is disposed below bottom end wall 28 and second port opening 218 is disposed within compartment 190 below bottom end wall 28.

Figure 13:
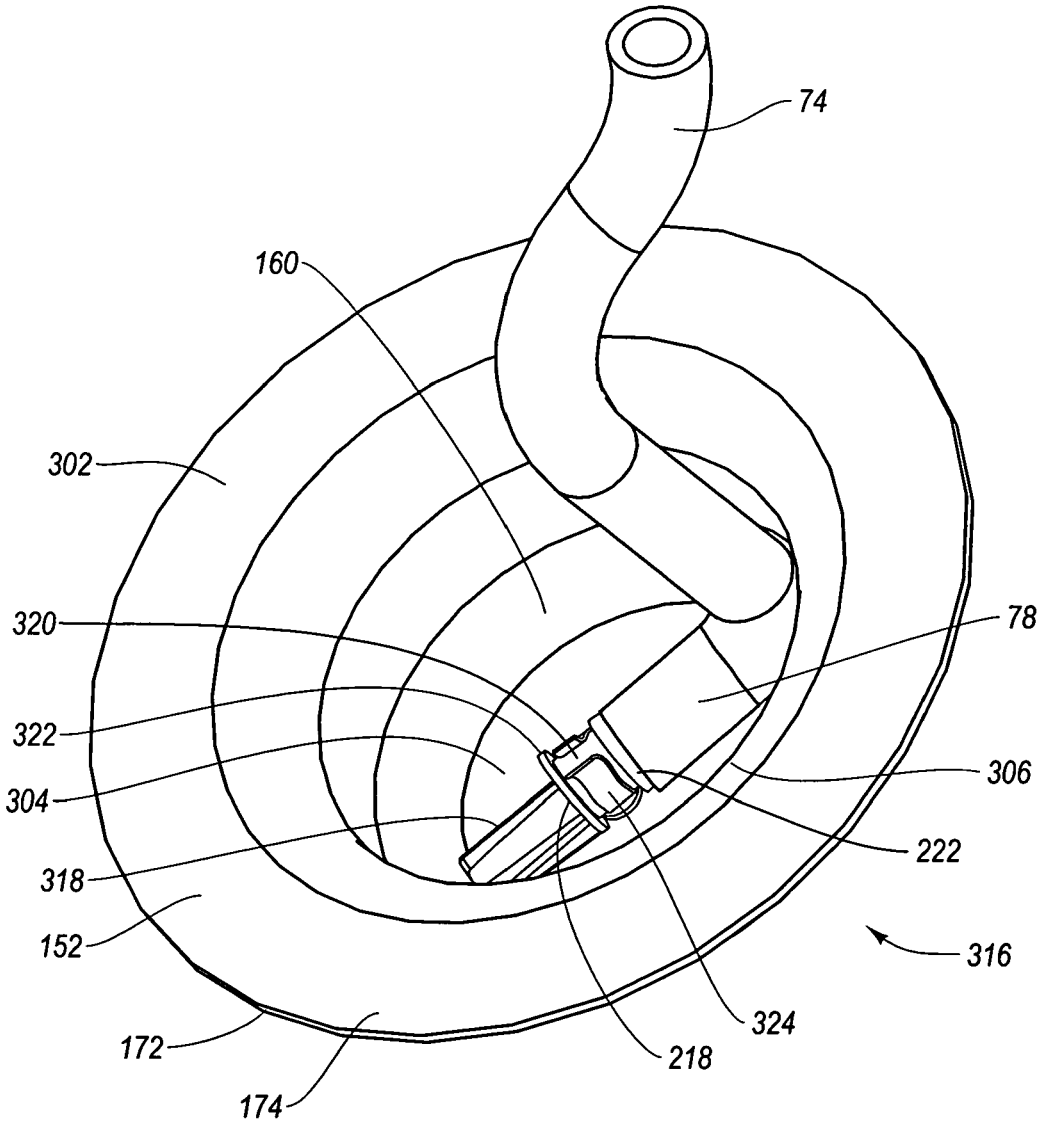
FIG. 13 is a perspective view of yet another alternative embodiment of a dip tube anchor assembly that includes an integral well with an anchor horizontally disposed therein.

Depicted in FIG. 13 is a final alternative embodiment of a dip tube anchor assembly 316 incorporating features of the present invention. Anchor assembly 316 includes well 302, as discussed above with regard to FIG. 12, and an anchor 318. Anchor 318 has a tubular side wall 320 having a first end fluid coupled with dip tube 74 and an opposing second end freely disposed within compartment 190 of well 302. Retainer 222 outwardly projects from side wall 320 and is biased against dip tube 74. A second retainer 322 outwardly projects from side wall 320 at a location spaced apart from retainer 222. A clip 324 is secured to or is integrally formed with floor 304 of well 302. Clip 324 engages with anchor 318 between retainers 222 and 322 so as to secure anchor 318 within compartment 190 of well 302. In this embodiment, anchor 318 is horizontally disposed within compartment 190. Second port opening 218 is located at the second end of anchor 318 and allows fluid to flow from compartment 190 to dip tube 74.

In alternative embodiments, it is appreciated that clip 324 can be replaced with a variety of alternative structures for securing anchor 318 to well 302. Likewise, anchor 318 can be integrally formed with well 302 or secured thereto such as by welding, adhesive or the like.

Figure 14:
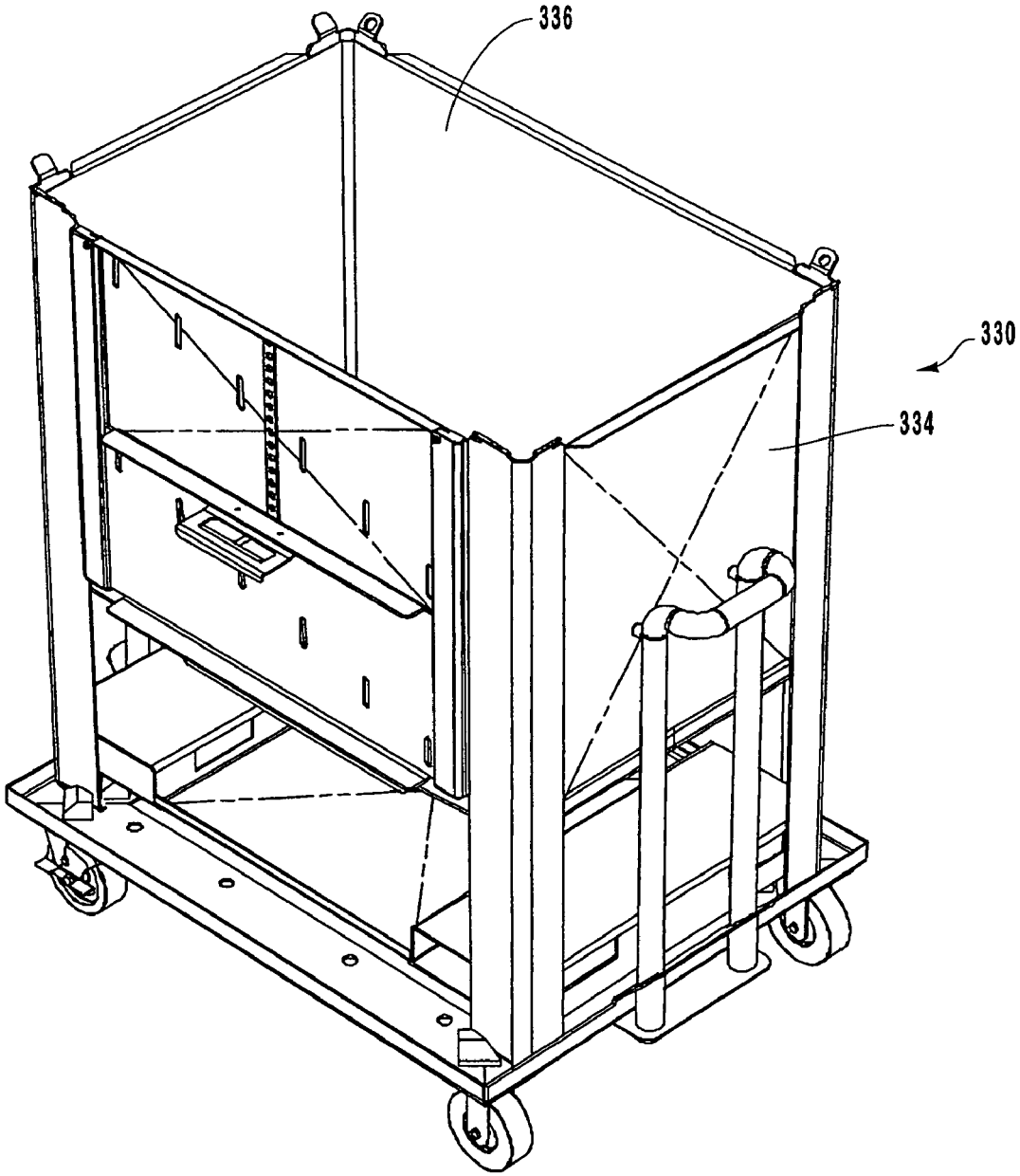
FIG. 14 is a perspective view of one embodiment of a support housing that can be used to house the container assembly of FIG. 1.
Figure 15:
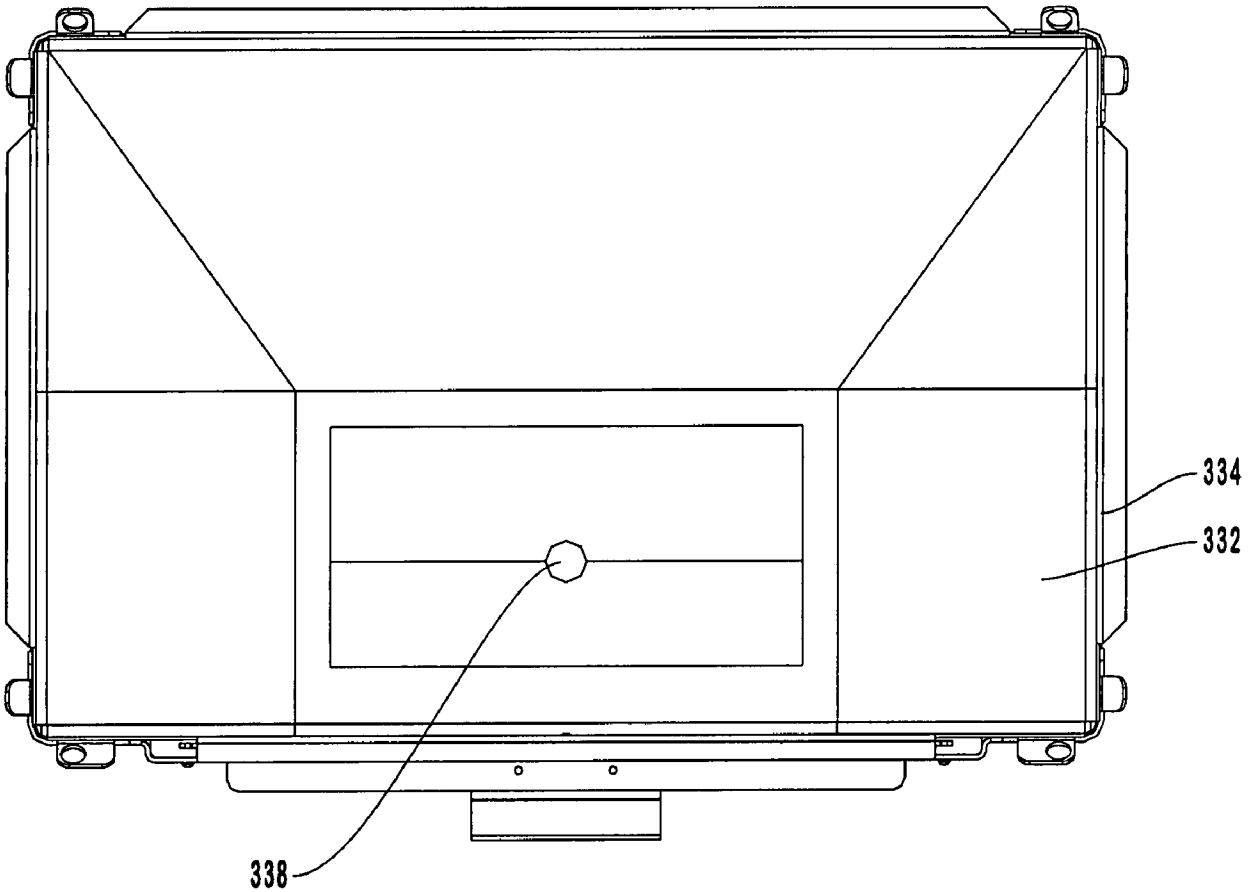
FIG. 15 is a top plan view of the support housing shown in FIG. 14.

Because container 12 is generally flexible, container 12 is typically disposed within a rigid or semi-rigid support housing during use. For example, depicted in FIGS. 14 and 15 is one embodiment of a support housing 330 which can be used to support container 12 during use. Support housing 330 comprises a floor 332 and an encircling side wall 334 upstanding therefrom. Floor 332 and side wall 334 bound a compartment 336 in which container 12 can be selectively positioned.

It is generally desirable that when container 12 is received within compartment 336, container 12 is uniformly supported by floor 332 and side wall 334 of support housing 330. Having at least generally uniform support of container 12 by support housing 330 helps to preclude failure of container 12 by hydraulic forces applied to container 12 when filled with a fluid.

Extending through floor 332 is an opening 338. Floor 332 is configured such that when bottom end wall 28 of container 12 is disposed on floor 332, the well, such as well 142 or the other wells disclosed herein, projects down through opening 338 on floor 332. As result, the well is able to project below bottom end wall 28 of container 12 so that the well remains a low point on container 12. Furthermore, positioning the well within opening 338 prevents the well from producing any unwanted stress on container 12.

It is appreciated that support housing 330 can come in a variety of different sizes, shaped and configuration to accommodate different containers. Further disclosure with regard to support housing 330 and alternative support housings which can be used in association with container 12 and the various dip tube anchors disclosed herein are disclosed in U.S. patent application Ser. No. 10/810,156, filed Mar. 26, 2004, which application is incorporated herein by specific reference.

It is also appreciated that other conventional support housings that are used in association with bags or containers having a bottom drain line can also be used in association with container assembly 10 of the present invention. Alternatively, in contrast to having an opening formed on the floor of a support housing through which the well projects, a support housing can be custom build having a closed recess formed on the floor thereof which receives the well. In one embodiment, it is also noted that the floor of the support housing can be sloped so as to assist in directing all fluid toward the well. For example, the floor could be frustoconical.

Figure 16:
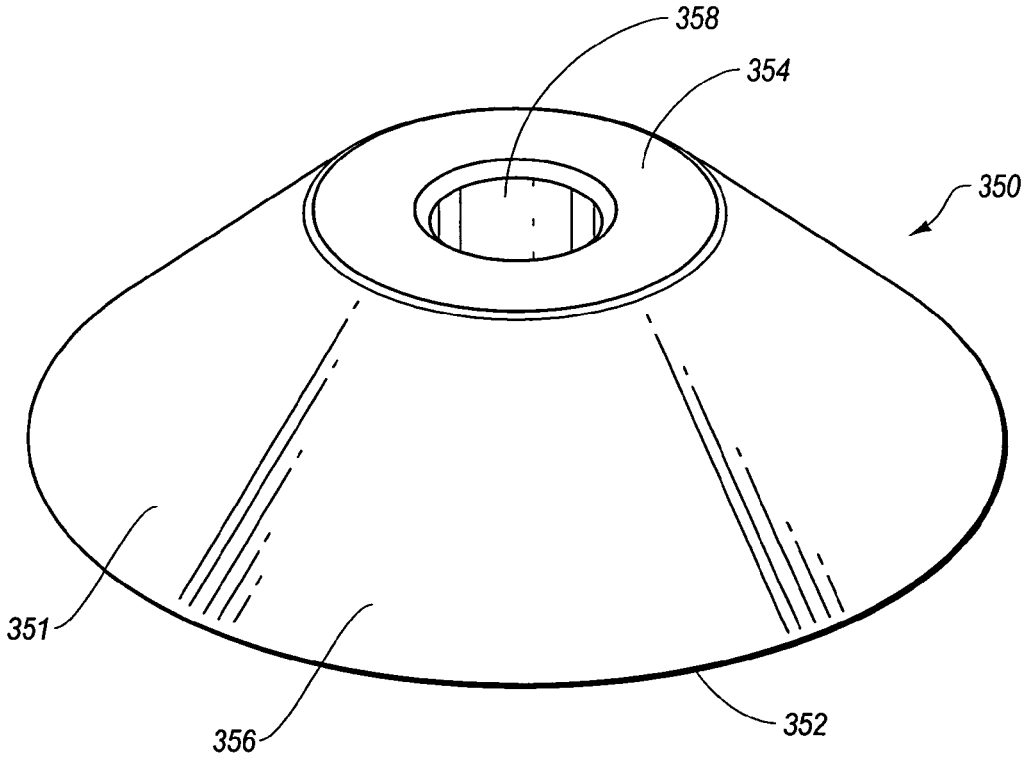
FIG. 16 is a perspective view of an anchor support.

In contrast to using container assembly 12 within a support housing having an opening or recess formed on the floor thereof to receive the dip tube anchor assembly, conventional support housings having a solid floor without an opening or recess can be used. For example, depicted in FIG. 16 is one embodiment of an anchor support 350 incorporating features of the present invention. Anchor support 350 comprises a body 351 having a circular bottom wall 352, a circular top wall 354, and a sloping side wall 356 that extends between bottom 352 and top wall 354. In this configuration, anchor support 350 has a substantially frustoconical configuration. A passage 358 centrally extends through anchor support 350 from top wall 354 to bottom wall 352.

It is appreciated that anchor support 350 can have a variety of different configurations. For example, bottom wall 352 and top wall 354 need not be circular but could have a polygonal, irregular or any other desired configuration. Likewise side wall 356 can be oriented at a variety of different angles and can be concave, convex, or have an irregular flow. Furthermore, passage 358 can be modified to form a closed end socket. As will become more apparent from the below discussion, anchor support 350 merely needs to provide a stable platform for the dip tube anchor assembly and should not have any sharp points or edges that could potentially damage container 12.

In one embodiment, anchor support 350 is made from a compressible polymeric foam such as polyethylene foam. One specific type of foam is F-ETHA polyethylene foam 1.7 PCF. In alternative embodiments, anchor support 350 can be comprised of rigid or flexible materials such as plastics, metals, composites or other materials.

Figure 17:
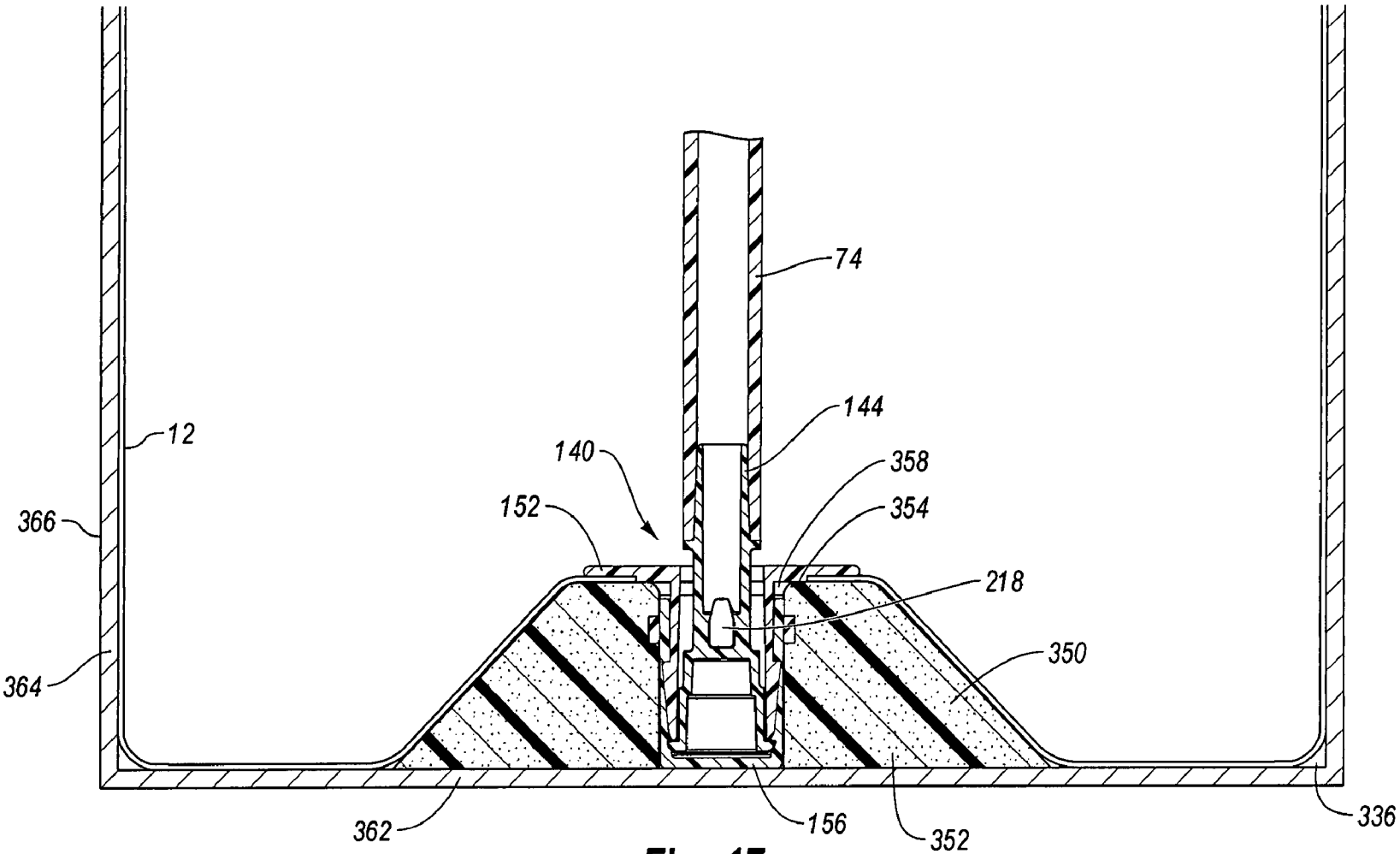
FIG. 17 is an elevated cross sectional side view of the container assembly shown in FIG. 1 mounted on the anchor support of FIG. 16 within a support housing.

Turning to FIG. 17, bottom wall 352 of anchor support 350 is resting on a floor 362 of a support housing 364. A side wall 366 upstands from floor 362. Container 12 is disposed within compartment 336 of support housing 364 with dip tube anchor assembly 140 being received within passage 358 of anchor support 350. In this position, mounting flange 152 rests against top wall 354 of anchor support 350 and cap 156 rests against floor 362 of support housing 364. In one alternative, anchor support 350 can suspend cap 156 off of floor 362. Container 12 is shown in an unfolded state, such as when filled with fluid. In this state, container 12 extends out from mounting flange 152 so as to extend over side wall 356 of anchor support 350 and onto floor 362 and side wall 366 of support housing 364.

Anchor support 350 functions to vertically support dip tube anchor assembly 140 so that it does not tip. Anchor support 350 is also designed to provide generally uniform support to the portion of container 12 that extends over anchor support 350. By making anchor support 350 out of a compressible foam, dip tube anchor assembly 140 can be easily secured within passage 358 by forming a tight friction fit with anchor support 350. This enables anchor support 350 to be secured to dip tube anchor assembly 140 while container is freely disposed outside of support housing 364. Once anchor support 350 is connected, container 12 can be lowed down into compartment 336 of support housing 364 until anchor support 350 comes to rest on floor 362. In alternative embodiments, it is appreciated that anchor support 350 can be integrally formed as part of dip tube anchor assembly 140 or that other fastening techniques such as mechanical fasteners, press fitting, welding, adhesives or the like can be used to secure dip tube anchor assembly 140 to anchor support 350.

In yet other embodiments, such as where support housing 364 has a side access that can be selectively opened and closed, dip tube anchor assembly 140 can be received within passage 358 of anchor support 350 after container 12 is received within support housing 364. In this embodiment, dip tube anchor assembly 140 can be freely disposed within passage 358 of anchor support 350 so that there is no fixed connection between dip tube anchor assembly 140 and anchor support 350. It is also appreciated that anchor support 350 can be connected to or integrally formed with floor 362 of support housing 364.

Anchor support 350 can be used in any situation where container 12 and dip tube anchor assembly 140 are used. That is, dip tube anchor assembly 140 still works in substantially the same way as discussed above even when anchor support 350 is used. Specifically, the fluid within chamber 18 of container 12 passes through second port 118 of anchor 144 and then travels out through dip tube 74.

Anchor support 350, however, is particularly useful where the support housing does not have an opening or recess formed on the floor thereof to receive dip tube anchor assembly 140. Anchor support 350 also has unique advantages when it is used with a container 12 that is not configured to vent. For example, container 12 can be configured so that no gases or fluids are allowed into container 12 while fluid is being drawn out of container 12. As a result, a vacuum produced within container 12 causes container 12, particularly when in the form of a flexible bag, to radially inwardly constrict or collapse as fluid is drawn out of container 12. This radial constriction begins at the top of container 12 and continues down toward the bottom of container 12 as the fluid level within container 12 drops.

Figure 18:
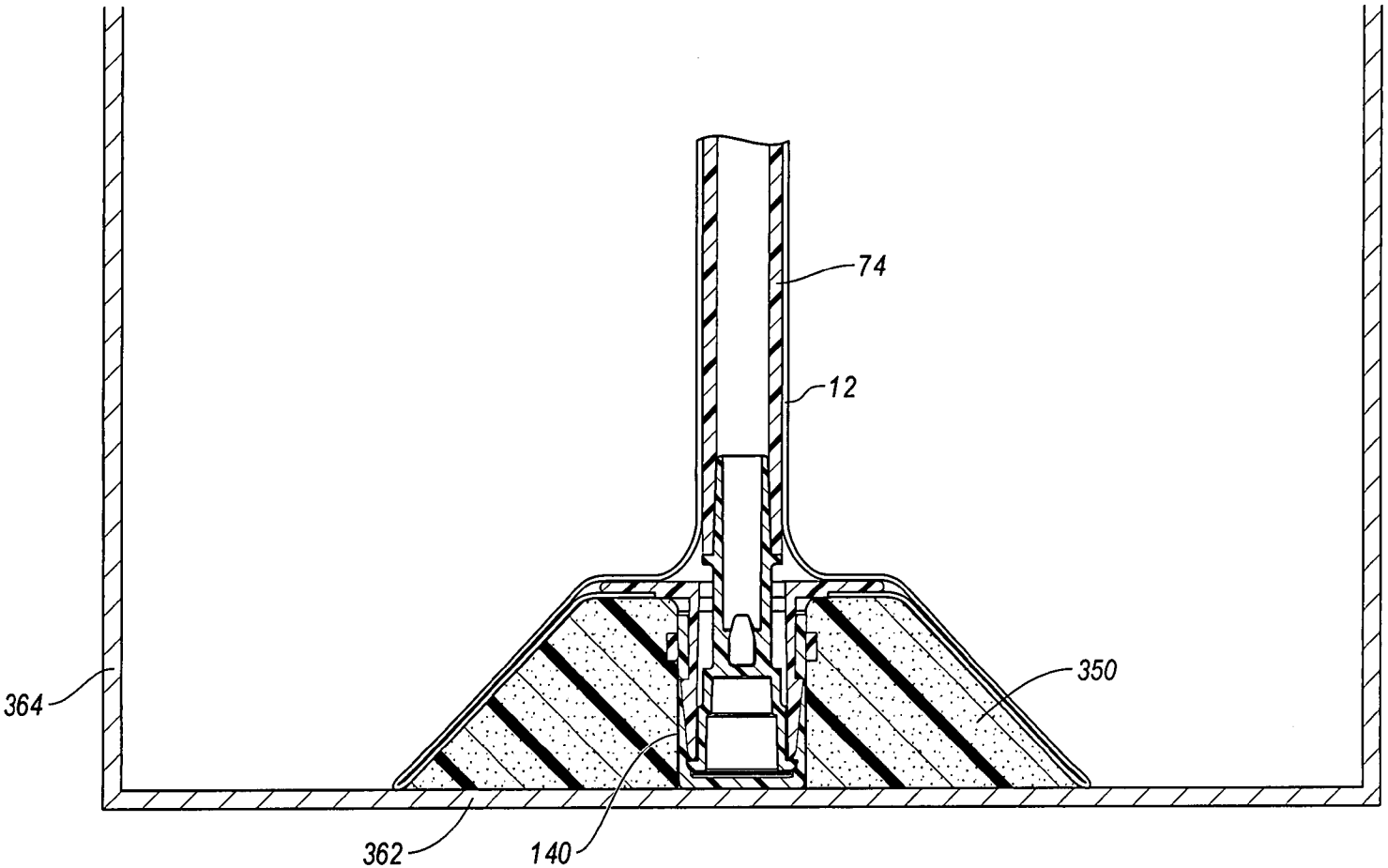
FIG. 18 is an elevated cross sectional side view of the assembly shown in FIG. 17 with the container being collapsed.

Turning to FIG. 18, as the fluid level approaches the bottom of container 12, the radial inward collapsing of container 12 forces the remaining fluid within container 12 toward dip tube anchor assembly 140. As such, even when anchor support 350 is used which extends above the floor of support housing 364, dip tube anchor assembly 140 is still able to substantially remove all of the fluid from within container 12.

To prevent vertical collapse of container 12 within support housing 364, various structures can be used to secure or maintain top end wall 26 of container 12 (FIG. 1) at or near the top of the support housing. For example, rods (not shown) can be passed through loops 30 (FIG. 1) on top end wall 26 of container 12. The rods can be positioned so as to span across compartment 336 of support housing and rest on the opposing sides of the top edge of the support housing. As a result, the rods vertically support container 12 while allowing free radial constriction of container 12. In an alternative embodiment, a bag hoist such as disclosed in U.S. patent application Ser. No. 10/810,156, which was previously incorporated by reference, can be used to vertically support container 12.

As previously discussed, anchor support 350 enables the use of container 12, dip tube anchor assembly 140 and the other dip tube anchor assemblies disclosed herein to be used with conventional support housings that do not have an opening or recess formed on the floor thereof. As such, container assembly 10 be used with existing inventors of such support housings without modifications. In some cases, such as where the fluid being handled is hazardous, it is desired that support housings be used which do not have an opening on the floor thereof in case there is a leak in container 12.

In one embodiment of the present invention means are provided for forming a compartment that extends below bottom end wall 28 of container 12 and communicates with chamber 18 of container 12. Examples of such means include the various well configurations as depicted in FIGS. 7, 10, 11, 12, and 13 and the various alternatives as discussed therewith. It is also appreciated that the various components of the different well configurations can be mixed and matched and that a variety of other well configurations can also be used that would achieve the same function.

One embodiment of the present invention also provides means for securing end 78 of dip tube 74 to a well so that dip tube 74 can draw in fluid located in the compartment of the well at a location below at least a portion of the interior surface of bottom end wall 28 of container 12. Examples of such means includes the various anchors as depicted in FIGS. 8, 10, 11, 12, and 13 and the various alternatives as discussed therewith. It is also appreciated that the various features of the different anchor configurations can be mixed and matched and that a variety of other anchor configurations can also be used that would achieve the same function.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A dip tube anchor assembly comprising:

a well comprising:

a reservoir having an exterior surface extending between a first end and an opposing second end, the reservoir also having an interior surface bounding a compartment, the compartment communicating through an opening formed at the first end of the reservoir;

a mounting flange outwardly projecting from the first end of the reservoir; and an anchor having a side wall extending between a first end and an opposing second end, the anchor further comprising a first port opening formed at the first end of the anchor, a second port opening formed on the side wall or at the second end of the anchor, and a fluid passageway extending between the first port opening and the second port opening, at least a portion of the anchor being secured within the compartment of the well such that at least a portion of the second port opening is disposed within the compartment.

2. The dip tube anchor assembly as recited in claim 1, wherein the reservoir comprises:

a tubular stem having a first end and an opposing second end and a channel extending therebetween, the mounting flange outwardly projecting from the first end of the tubular stem; and a cap mounted on the tubular stem so as to seal the channel of the stem at the second end of the stem.

3. The dip tube anchor assembly as recited in claim 2, further comprising a barb radially outwardly projecting from the second end of the stem, the barb engaging with the cap.

4. The dip tube anchor assembly as recited in claim 1, wherein the reservoir comprises:

a tubular stem having a first end and an opposing second end and a channel extending therebetween, the mounting flange outwardly projecting from the first end of the tubular stem; and a tube having a first end and an opposing second end, the first end of the tube being fluid coupled with the second end of the stem; and a plug secured within the second end of the tube.

5. The dip tube anchor assembly as recited in claim 1, wherein the reservoir comprises:

a side wall having a first end and an opposing second end, the side wall encircling the compartment; and a floor formed at the second end of the side wall, wherein the side wall, floor, and mounting flange are integrally formed.

6. The dip tube anchor assembly as recited in claim 1, wherein the reservoir comprises a dish.

7. The dip tube anchor assembly as recited in claim 1, wherein the mounting flange is at least substantially disposed within a plane and encircles and radially outwardly projects from the first end of the reservoir.

8. The dip tube anchor assembly as recited in claim 1, wherein the anchor comprises:

a tubular spout having a first end and an opposing second end, the first port opening being formed at the first end of the tubular spout and the second port opening being formed on a side of the tubular spout at the second end thereof; and a base mounted on the second end of the spout.

9. The dip tube anchor assembly as recited in claim 8, wherein the spout is tapered along the length thereof.

10. The dip tube anchor assembly as recited in claim 8, further comprising a retainer outwardly projecting from the spout at a location between the first port opening and the second port opening.

11. The dip tube anchor assembly as recited in claim 2, wherein the anchor comprises:

a tubular spout having a first end and an opposing second end, the first port opening being formed at the first end of the tubular spout and the second port opening being formed on a side of the tubular spout at the second end;

a base mounted on the second end of the spout;

a lip radially outwardly projecting from the base, the anchor being received within the stem so that the lip biases against the second end of the stem.

12. The dip tube anchor assembly as recited in claim 4, wherein the anchor is at least partially disposed within the tubular stem and the second port opening is disposed within the stem or between the stem and the plug.

13. The dip tube anchor assembly as recited in claim 5, wherein the anchor is secured to or is integrally formed with the floor of the reservoir.

14. The dip tube anchor assembly as recited in claim 1, further comprising an anchor support having a top wall, an opposing bottom wall, and a sidewall extending therebetween, an opening being formed on the top wall, the reservoir being at least partially disposed within the opening.

15. The dip tube anchor assembly as recited in claim 14, wherein the mounting flange is resting on the top wall of the anchor support.

16. The dip tube anchor assembly as recited in claim 14, wherein the anchor support is comprised of a compressible polymeric foam.

17. A container assembly comprising:

a container bounding a chamber and having a floor; and the dip tube anchor assembly recited in claim 1, at least a portion of the dip tube anchor assembly being disposed within the chamber or extending below the floor of the container.

18. A method for assembling a container assembly, the method comprising:

securing the dip tube anchor assembly recited in claim 1 to a floor of a fluid container that at least partially bounds a chamber; and coupling a dip tube to the dip tube anchor assembly such that the dip tube draws fluid out of the compartment of the dip tube anchor assembly.

19. A container assembly comprising:

a container having a floor and bounding a chamber, the floor having a hole passing therethrough and the container being comprised of a polymeric material;

means for forming a compartment that extends below the floor of the container and communicates with the chamber of the container through the hole, at least a portion of the means for forming a compartment being disposed external to the container;

an anchor having a side wall extending between a first end and an opposing second end, the anchor further comprising a first port opening formed at the first end of the anchor, a second port opening formed on the side wall or at the second end of the anchor, and a fluid passageway extending between the first port opening and the second port opening, at least a portion of the anchor being secured within the compartment such that at least a portion of the second port opening is disposed within the compartment; and a dip tube having a first end and an opposing second end, the second end of the dip tube being fluid coupled with the first port opening of the anchor.

20. The container assembly as recited in claim 19, wherein the container comprises a flexible bag.

21. The container assembly as recited in claim 20, wherein the bag has a top wall with at least one port formed thereon.

22. The container assembly as recited in claim 21, wherein the first end of the dip tube is at least partially disposed within or is adjacent to the at least one port formed on the top wall of the bag.

23. The container assembly as recited in claim 20, wherein the bag is comprised of one or more layers.

24. The container assembly as recited in claim 20, wherein the bag is comprised of a plurality of panels seamed together.

25. The container assembly as recited in claim 19, wherein the means for forming a compartment comprises:

a port having a tubular stem with a first end and an opposing second end and a mounting flange radially outwardly projecting from the first end of the stem, the mounting flange being sealed against an interior surface of the floor of the container and the stem projecting through a hole formed on the floor of the container; and a cap mounted on the port so as to seal the second end of the stem.

26. The container assembly as recited in claim 25, wherein the anchor is at least partially disposed within the tubular stem of the port so that the second port opening is at least partially disposed within the stem of the port.

27. The container assembly as recited in claim 19, wherein the means for forming a compartment comprises:

a side wall having a first end and an opposing second end, the side wall encircling the compartment;

a floor formed at the second end of the side wall; and a mounting flange radially outwardly projecting from the first end of the side wall, the mounting flange being sealed against an interior surface of the floor of the container and the side wall projecting through a hole formed on the floor of the container.

28. The container assembly as recited in claim 27, wherein the side wall, floor, and mounting flange are integrally formed.

29. The container assembly as recited in claim 27, wherein the anchor is secured to or integrally formed with the floor.

30. A container assembly comprising:

a container bounding a chamber and having a floor with an interior surface, the floor having a hole passing therethrough and the container being comprised of a flexible polymeric material;

a well mounted on the floor of the container so that at least a portion of the well passes through the hole on the floor of the container, the well having an interior surface that bounds a compartment that extends below the interior surface of the floor of the container, the compartment being in fluid communication with the chamber of the container;

a dip tube having a first end and an opposing second end; and means for securing the first end of the dip tube to the well so that the dip tube can draw in fluid located in the compartment of the well at a location below at least a portion of the interior surface of the floor of the container.

31. The container assembly as recited in claim 30, wherein the container comprises a flexible bag.

32. The container assembly as recited in claim 30, wherein the bag has a top wall with at least one port formed thereon, the first end of the dip tube being at least partially disposed within or adjacent to the at least one port formed on the top wall of the bag.

33. The container assembly as recited in claim 30, wherein the well comprises:

a tubular stem having a first end and an opposing second end, the second end projecting below the floor of the container;

a mounting flange radially outwardly projecting from the first end of the stem, the mounting flange being sealed against the floor of the container; and a cap mounted on the stem so as to seal the second end of the stem.

34. The container assembly as recited in claim 33, wherein the means for securing comprises an having a side wall extending between a first end and an opposing second end, the anchor having a first port opening formed at the first end of the thereof, a second port opening formed on the side wall or at the second end of thereof, and a fluid passageway extending between the first port opening and the second port opening, the first end of the anchor being fluid coupled with the second end of the dip tube, the second end of the anchor being disposed within the compartment of the well such that the second port opening is disposed at least partially within the compartment of the well.

35. The container assembly as recited in claim 34, further comprising a lip outwardly projecting from the second end of the anchor, the anchor being at least partially disposed within tubular stem of the well such that the lip is biased against the second end of the tubular stem of the well.

36. The container assembly as recited in claim 30, wherein the means for securing comprises a tubular spout having a side wall extending between a first end and an opposing second end, the tubular spout having a first port opening formed at the first end thereof, a second port opening formed on the side wall or at the second end of the tubular spout, and a fluid passageway extending between the first port opening and the second port opening, the first end of the spout being fluid coupled with the second end of the dip tube, the second end of the spout being disposed within the compartment of the well such that the second port opening is disposed within the compartment of the well.

37. The container assembly as recited in claim 36, wherein the tubular spout is integrally formed with or is mechanically connected to the well.

38. The container assembly as recited in claim 30, wherein the well has a length that is less than 15 cm.

39. The container assembly as recited in claim 30, further comprising an anchor support having a top wall and a bottom wall, an opening being formed on the top wall, at least a portion of the well disposed outside of the chamber of the container being disposed within the opening of the anchor support.

40. The container assembly as recited in claim 39, wherein the anchor support is comprised of a compressible polymeric foam.

41. The container assembly as recited in claim 39, wherein the anchor support has a substantially frustoconical configuration.

42. The container assembly as recited in claim 39, wherein opening comprises a passage extending through the anchor support.

43. A container assembly comprising:

a container bounding a chamber and having a floor with an interior surface, the container being comprised of a polymeric material;

a well connected to the floor of the container, the well having an interior surface that bounds a compartment that extends below the interior surface of the floor of the container, the compartment being in fluid communication with the chamber of the container, the well projecting through the floor of the container;

an anchor having a side wall extending between a first end and an opposing second end, the anchor further comprising a first port opening formed at the first end of the anchor, a second port opening formed on the side wall or at the second end of the anchor, and a fluid passageway extending between the first port opening and the second port opening, at least a portion of the anchor being secured within the compartment of the well; and a dip tube fluid coupled with the first port opening of the anchor.

44. The container assembly as recited in claim 43, wherein the second port opening of the anchor is disposed within the compartment of the well at a location below of the floor of the container.

45. The container assembly as recited in claim 43, wherein the well has a length that is less than 15 cm.

46. The container assembly as recited in claim 43, wherein the well has a maximum inner diameter that is less than 10 cm.

47. The container assembly as recited in claim 43, wherein the container comprises a flexible bag.

48. The container assembly as recited in claim 47, wherein the bag has a top wall with at least one port formed thereon, the first end of the dip tube being disposed within the at least one port.

49. The container assembly as recited in claim 43, wherein the well comprises:

a tubular stem having a first end and an opposing second end and a channel extending therebetween;

a mounting flange outwardly projecting from the first end of the tubular stem and connected to the floor of the container, the mounting flange being integrally formed with tubular stem; and a cap mounted on the tubular stem so as to seal the channel of the stem at the second end of the stem.

50. The container assembly as recited in claim 43, further comprising an anchor support having a top wall and a bottom wall, an opening being formed on the top wall, at least a portion of the well being disposed within the opening of the anchor support.

51. The container assembly as recited in claim 50, wherein the anchor support is comprised of a compressible polymeric foam.

52. The container assembly as recited in claim 50, wherein the anchor support has a substantially frustoconical configuration.

53. The container assembly as recited in claim 50, wherein opening comprises a passage extending through the anchor support.

54. A method for assembling a container assembly, the method comprising:

securing a dip tube anchor assembly to a floor of a fluid container that at least partially bounds a chamber, the dip tube anchor assembly having an interior surface that bounds a compartment that communicates with the chamber of the container and extends through the floor of the container; and coupling a dip tube to the dip tube anchor assembly such that the dip tube draws fluid out of the compartment of the dip tube anchor assembly at a location below the floor of the container.

55. A method for assembling a container assembly, the method comprising:

inserting an anchor into a port, the port being located on a bottom floor of a polymeric bag and extending through the polymeric bag, the anchor having a first port opening, a spaced apart second port opening and a fluid passageway extending therebetween;

mounting a cap on the port so as to secure at least a portion of the anchor within the port; and connecting a first end of a dip tube to the anchor so that the dip tube is in fluid communication with the first port opening of the anchor, the dip tube being connected to the anchor either before or after the anchor is inserted within the port.

56. The method as recited in claim 55, further comprising positioning a second end of the dip tube within a port positioned on a top end wall of the bag.

57. The method as recited in claim 55, further comprising positioning the polymeric bag within a chamber of a rigid housing, the rigid housing having a floor with an opening extending therethrough, the port on the floor of the bag being disposed within the opening on the floor of the rigid housing.

58. The method as recited in claim 55, further comprising positioning the cap mounted on the port into an opening formed on an anchor support.

* * * * *

UNITED STATES PATENT AND TRADEMARK OFFICE

CERTIFICATE OF CORRECTION

PATENT NO. : 7,225,824 B2 
APPLICATION NO. : 10/954090
DATED : June 5, 2007
INVENTOR(S) : West et al.

It is certified that error appears in the above-identified patent and that said Letters Patent is hereby corrected as shown below:

Drawings

Sheet 4, replace FIG. 4 with figure provided below, wherein detail "114" has been changed to detail --112--

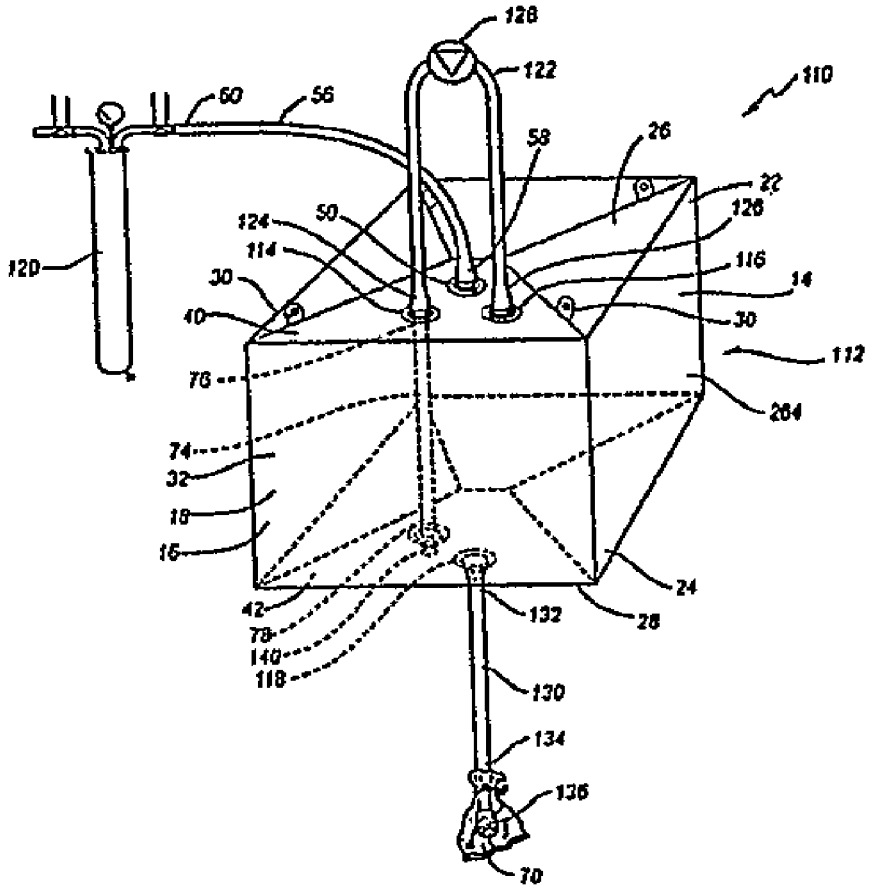

UNITED STATES PATENT AND TRADEMARK OFFICE

CERTIFICATE OF CORRECTION

PATENT NO. : 7,225,824 B2
APPLICATION NO. : 10/954090
DATED : June 5, 2007
INVENTOR(S) : West et al.

It is certified that error appears in the above-identified patent and that said Letters Patent is hereby corrected as shown below:

Drawings (cont'd)

Sheet 11, replace FIG. 11 with the figure provided below, wherein detail --288-- has been added

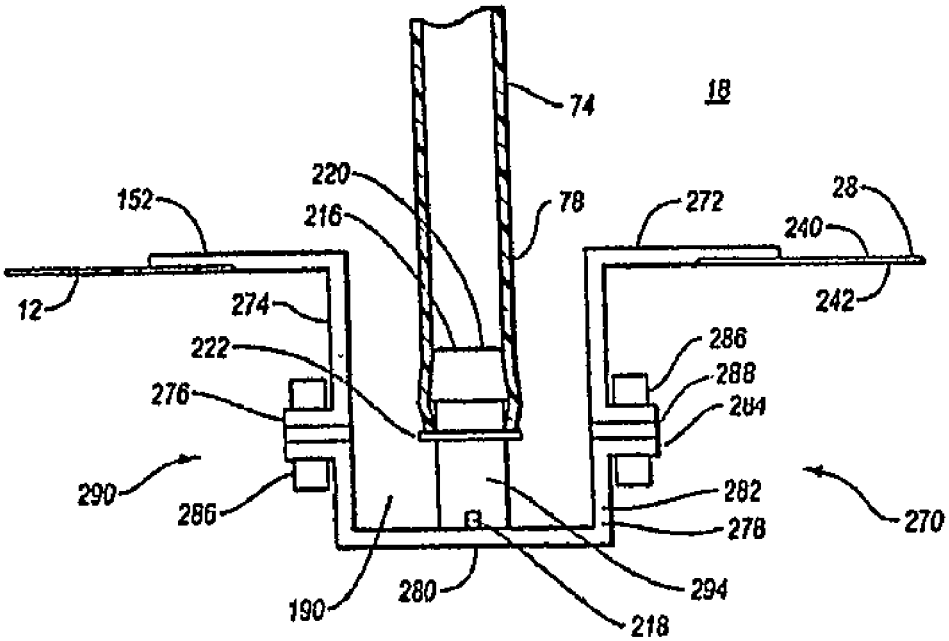

Fig. 11

UNITED STATES PATENT AND TRADEMARK OFFICE

CERTIFICATE OF CORRECTION

PATENT NO. : 7,225,824 B2 
APPLICATION NO. : 10/954090
DATED : June 5, 2007
INVENTOR(S) : West et al.

It is certified that error appears in the above-identified patent and that said Letters Patent is hereby corrected as shown below:

Drawings (cont'd)
Sheet 17, replace FIG. 17 with the figure provided below, wherein detail --356-- has been added

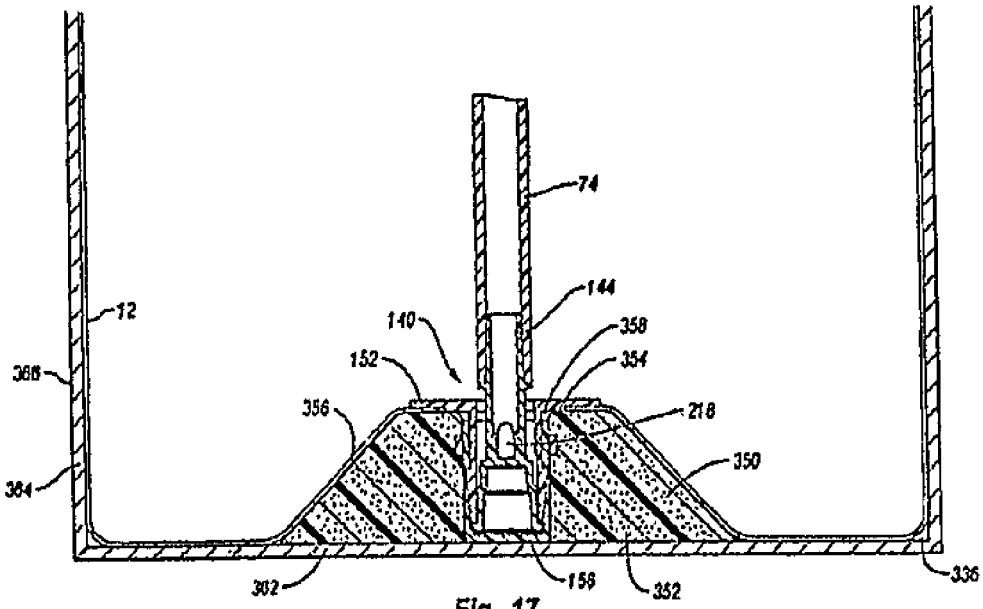

Fig. 17

Column 1
Line 18, change "lowed" to --lowered--
Line 28, change "use" to --used--
Line 34, after "from", remove --of--
Line 44, change "pate" to --plate--
Line 63, after "to", insert --the--

Column 3
Line 54, change "130" to --14--

Column 5
Line 22, change "us" to --is--

Column 6
Line 53, after "fluid", remove "a"
Line 57, after "container", insert --112--

UNITED STATES PATENT AND TRADEMARK OFFICE

CERTIFICATE OF CORRECTION

PATENT NO. : 7,225,824 B2
APPLICATION NO. : 10/954090
DATED : June 5, 2007
INVENTOR(S) : West et al.

It is certified that error appears in the above-identified patent and that said Letters Patent is hereby corrected as shown below:

Column 7
Line 2, change “assembles” to --assemblies--
Line 67, after “used”, insert --to--

Column 9
Line 31, change “though” to --through--
Line 38, after “second”, insert --end--
Line 60, change “maximize” to --maximizes--

Column 10
Line 32, change “element” to --elements--
Line 44, change “26” to --258--

Figure 11:
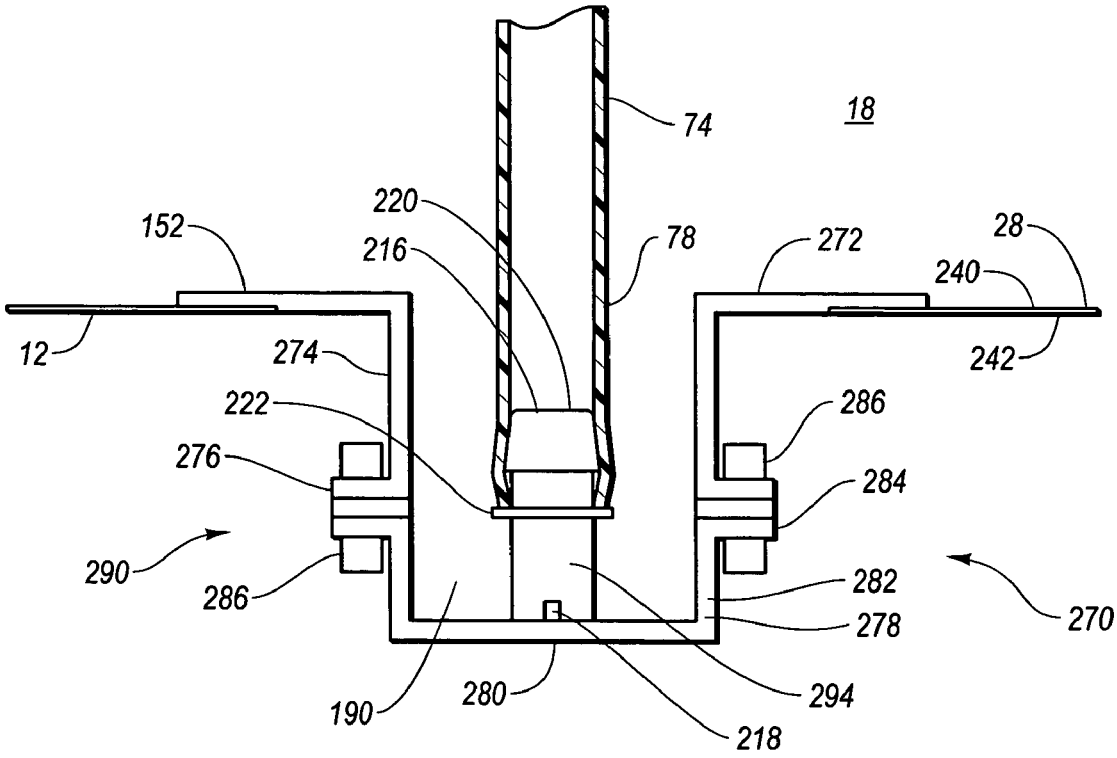
FIG. 11 is a cross sectional side view of an alternative embodiment of a dip tube anchor assembly that includes a dish clamped to a port.

Column 11
Line 7, change “FIG. 10” to --FIG. 11--

Column 12
Line 54, change “build” to --built--

Column 13
Line 50, after “container”, insert --12--
Line 52, change “lowed” to --lowered--

Column 14
Line 52, before “be”, insert --can--
Line 52, change “inventors” to --inventions--

UNITED STATES PATENT AND TRADEMARK OFFICE

CERTIFICATE OF CORRECTION

PATENT NO. : 7,225,824 B2
APPLICATION NO. : 10/954090
DATED : June 5, 2007
INVENTOR(S) : West et al.

It is certified that error appears in the above-identified patent and that said Letters Patent is hereby corrected as shown below:

Column 19
Line 43, after "below", remove "of"

Signed and Sealed this

Eleventh Day of December, 2007

JON W. DUDAS
*Director of the United States Patent and Trademark Office*